US007914132B2

(12) United States Patent
Morgan et al.

(10) Patent No.: US 7,914,132 B2
(45) Date of Patent: Mar. 29, 2011

(54) INKJET PRINTER WITH SELECTIVELY ISOLATABLE PUMP

(75) Inventors: John Douglas Peter Morgan, Balmain (AU); David John Worboys, Balmain (AU); Miao Wang, Balmain (AU); Patrick John McAuliffe, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 705 days.

(21) Appl. No.: 11/872,719

(22) Filed: Oct. 16, 2007

(65) Prior Publication Data

US 2009/0096852 A1 Apr. 16, 2009

(51) Int. Cl.
*B41J 2/175* (2006.01)

(52) U.S. Cl. ..... 347/85; 347/86

(58) Field of Classification Search ..... 347/85, 347/86

See application file for complete search history.

(56) References Cited

U.S. PATENT DOCUMENTS

| | | | | |
|---|---|---|---|---|
| 4,399,446 | A | 8/1983 | McCann et al. | |
| 5,691,753 | A | 11/1997 | Hilton | |
| 5,724,081 | A * | 3/1998 | Maechler et al. | 347/87 |
| 2005/0157107 | A1 * | 7/2005 | Silverbrook et al. | 347/85 |

FOREIGN PATENT DOCUMENTS

JP 2007-030524 A 2/2007

* cited by examiner

*Primary Examiner* — Laura E Martin

(57) ABSTRACT

An inkjet printer that has a printhead for printing onto a media substrate, a reservoir for supplying ink to the printhead, a pump for drawing ink from the reservoir and pumping ink into the printhead and, a valve arrangement for selectively opening fluid communication between the pump and the printhead, and closing fluid communication between the pump and the printhead while opening fluid communication between the reservoir and the printhead.

10 Claims, 4 Drawing Sheets

INKJET PRINTER WITH SELECTIVELY ISOLATABLE PUMP

FIELD OF THE INVENTION

The present invention relates to printers and in particular the fluidic architecture of inkjet printers.

CO-PENDING APPLICATIONS

The following application has been filed by the Applicant simultaneously with the present application: Ser. No. 11/872,718

The disclosure of this co-pending application is incorporated herein by reference. The above application has been identified by its filing docket number, which will be substituted with the corresponding application number, once assigned.

CROSS REFERENCES TO RELATED APPLICATIONS

Various methods, systems and apparatus relating to the present invention are disclosed in the following U.S. patents/patent applications filed by the applicant or assignee of the present invention:

| | | | | | |
|---|---|---|---|---|---|
| 6,276,850 | 6,520,631 | 6,158,907 | 6,539,180 | 6,270,177 | 6,405,055 |
| 6,628,430 | 6,835,135 | 6,626,529 | 6,981,769 | 7,125,338 | 7,125,337 |
| 7,136,186 | 10/920,372 | 7,145,689 | 7,130,075 | 7,081,974 | 7,177,055 |
| 7,209,257 | 6,443,555 | 7,161,715 | 7,154,632 | 7,158,258 | 7,148,993 |
| 7,075,684 | 10/943,905 | 10/943,906 | 10/943,904 | 10/943,903 | 10/943,902 |
| 6,966,659 | 6,988,841 | 7,077,748 | 7,255,646 | 7,070,270 | 7,014,307 |
| 7,158,809 | 7,217,048 | 11/225,172 | 11/255,942 | 11/329,039 | 11/329,040 |
| 7,271,829 | 11/442,189 | 11/474,280 | 11/483,061 | 11/503,078 | 11/520,735 |
| 11/505,858 | 11/525,850 | 11/583,870 | 11/592,983 | 11/592,208 | 11/601,828 |
| 11/635,482 | 11/635,526 | 10/466,440 | 7,215,441 | 11/650,545 | 11/653,241 |
| 11/653,240 | 7,056,040 | 6,942,334 | 11/706,300 | 11/740,265 | 11/737,720 |
| 11/739,056 | 11/740,204 | 11/740,223 | 11/753,557 | 11/750,285 | 11,758,648 |
| 11/778,559 | 11,834,634 | 11/838,878 | 11,845,669 | 6,799,853 | 7,237,896 |
| 6,749,301 | 10/451,722 | 7,137,678 | 7,252,379 | 7,144,107 | 10/503,900 |
| 10/503,898 | 10/503,897 | 7,220,068 | 7,270,410 | 7,241,005 | 7,108,437 |
| 7,140,792 | 10/503,922 | 7,224,274 | 10/503,917 | 10/503,918 | 10/503,925 |
| 10/503,927 | 10/503,928 | 10/503,929 | 10/503,885 | 7,195,325 | 7,229,164 |
| 7,150,523 | 10/503,889 | 7,154,580 | 6,906,778 | 7,167,158 | 7,128,269 |
| 6,688,528 | 6,986,613 | 6,641,315 | 10/503,890 | 10/503,891 | 7,150,524 |
| 7,155,395 | 6,915,140 | 6,999,206 | 6,795,651 | 6,883,910 | 7,118,481 |
| 7,136,198 | 7,092,130 | 6,786,661 | 6,808,325 | 10/920,368 | 10/920,284 |
| 7,219,990 | 10/920,283 | 6,750,901 | 6,476,863 | 6,788,336 | 6,322,181 |
| 6,597,817 | 6,227,648 | 6,727,948 | 6,690,419 | 10/470,947 | 6,619,654 |
| 6,969,145 | 6,679,582 | 10/470,942 | 6,568,670 | 6,866,373 | 10/102,696 |
| 7,008,044 | 6,742,871 | 6,966,628 | 6,644,781 | 6,969,143 | 6,767,076 |
| 6,834,933 | 6,692,113 | 6,913,344 | 6,727,951 | 7,128,395 | 7,036,911 |
| 7,032,995 | 6,969,151 | 6,955,424 | 6,969,162 | 10/919,249 | 6942315-B2 |
| 11/006,577 | 7,234,797 | 6,986,563 | 11/063,577 | 11/045,442 | 11/124,044 |
| 11/124,284 | 7,077,330 | 6,196,541 | 11/149,389 | 11/185,725 | 7,226,144 |
| 11/202,344 | 7,267,428 | 11/248,423 | 11/248,422 | 7,093,929 | 11/282,769 |
| 11/330,060 | 11/442,111 | 11/472,406 | 11/499,806 | 11/499,710 | 6,195,150 |
| 11,749,156 | 11,782,588 | 11/854,435 | 11/853,817 | 6,362,868 | 6,831,681 |
| 6,431,669 | 6,362,869 | 6,472,052 | 6,356,715 | 6,894,694 | 6,636,216 |
| 6,366,693 | 6,329,990 | 6,459,495 | 6,137,500 | 6,690,416 | 7,050,143 |
| 6,398,328 | 7,110,024 | 6,431,704 | 6,879,341 | 6,415,054 | 6,665,454 |
| 6,542,645 | 6,486,886 | 6,381,361 | 6,317,192 | 6,850,274 | 09/113,054 |
| 6,646,757 | 6,624,848 | 6,357,135 | 6,271,931 | 6,353,772 | 6,106,147 |
| 6,665,008 | 6,304,291 | 6,305,770 | 6,289,262 | 6,315,200 | 6,217,165 |
| 6,496,654 | 6,859,225 | 6,924,835 | 6,647,369 | 6,943,830 | 09/693,317 |
| 7,021,745 | 6,712,453 | 6,460,971 | 6,428,147 | 6,416,170 | 6,402,300 |
| 6,464,340 | 6,612,687 | 6,412,912 | 6,447,099 | 6,837,567 | 6,505,913 |
| 7,128,845 | 6,733,684 | 7,249,108 | 6,566,858 | 6,331,946 | 6,246,970 |
| 6,442,525 | 09/517,384 | 09/505,951 | 6,374,354 | 7,246,098 | 6,816,968 |
| 6,757,832 | 6,334,190 | 6,745,331 | 7,249,109 | 10/203,559 | 7,197,642 |
| 7,093,139 | 10/636,263 | 10/636,283 | 10/866,608 | 7,210,038 | 10/902,833 |
| 10/940,653 | 10/942,858 | 11/706,329 | 11/757,385 | 11/758,642 | 7,119,836 |

-continued

| | | | | | |
|---|---|---|---|---|---|
| 10/322,698 | 10/642,331 | 10/636,285 | 7,170,652 | 6,967,750 | 6,995,876 |
| 7,099,051 | 7,172,191 | 7,243,916 | 7,222,845 | 11/239,232 | 11/055,276 |
| 7,063,940 | 11/107,942 | 7,193,734 | 7,086,724 | 7,090,337 | 11/185,952 |
| 7,140,717 | 11/190,902 | 11/209,711 | 7,256,824 | 7,140,726 | 7,156,512 |
| 7,186,499 | 11/478,585 | 11/525,862 | 11/540,574 | 11/583,875 | 11/592,181 |
| 6,750,944 | 11/599,336 | 11/650,548 | 11,744,183 | 11/758,646 | 11/778,561 |
| 11/839,532 | 11/838,874 | 11/853,021 | 11/869,710 | 11/868,531 | 10/636,225 |
| 10/510,094 | 6,985,207 | 6,773,874 | 6,650,836 | 10/666,495 | 10/636,224 |
| 7,250,975 | 10/636,214 | 6,880,929 | 7,236,188 | 7,236,187 | 7,155,394 |
| 10/636,219 | 10/636,223 | 7,055,927 | 6,986,562 | 7,052,103 | 10/656,469 |
| 10/656,281 | 10/656,791 | 10/666,124 | 10/683,217 | 10/683,197 | 7,095,533 |
| 6,914,686 | 6,896,252 | 6,820,871 | 6,834,851 | 6,848,686 | 6,830,246 |
| 6,851,671 | 10/729,098 | 7,092,011 | 7,187,404 | 10/729,159 | 10/753,458 |
| 6,878,299 | 6,929,348 | 6,921,154 | 10/780,625 | 10/804,042 | 6,913,346 |
| 10/831,238 | 10/831,237 | 10/831,239 | 10/831,240 | 10/831,241 | 10/831,234 |
| 10/831,233 | 7,246,897 | 7,077,515 | 10/831,235 | 10/853,336 | 10/853,659 |
| 10/853,681 | 6,913,875 | 7,021,758 | 7,033,017 | 7,161,709 | 7,099,033 |
| 7,147,294 | 7,156,494 | 11/012,024 | 11/011,925 | 7,032,998 | 7,044,585 |
| 11/007,250 | 6,994,424 | 11/006,787 | 7,258,435 | 7,097,263 | 7,001,012 |
| 7,004,568 | 7,040,738 | 7,188,933 | 7,027,080 | 7,025,446 | 6,991,321 |
| 7,131,715 | 7,261,392 | 7,207,647 | 7,182,435 | 7,097,285 | 11/228,410 |
| 7,097,284 | 7,083,264 | 7,147,304 | 7,232,203 | 7,156,498 | 7,201,471 |
| 11/501,772 | 11/503,084 | 11/513,073 | 7,210,764 | 11/635,524 | 11/706,379 |
| 11/730,386 | 11/730,784 | 11/753,568 | 11/782,591 | 11/859,783 | 6,710,457 |
| 6,775,906 | 6,507,099 | 7,221,043 | 7,107,674 | 7,154,172 | 11/442,400 |
| 7,247,941 | 11/736,540 | 11/758,644 | 6,530,339 | 6,631,897 | 6,851,667 |
| 6,830,243 | 6,860,479 | 6,997,452 | 7,000,913 | 7,204,482 | 11/212,759 |
| 11/281,679 | 11/730,409 | 6,238,044 | 6,425,661 | 11/003,786 | 7,258,417 |
| 11/003,418 | 11/003,334 | 7,270,395 | 11/003,404 | 11/003,419 | 11/003,700 |
| 7,255,419 | 11/003,618 | 7,229,148 | 7,258,416 | 7,273,263 | 7,270,393 |
| 6,984,017 | 11/003,699 | 11/071,473 | 7,156,497 | 11/601,670 | 11,748,482 |
| 11/778,563 | 11/779,851 | 11/778,574 | 11/853,816 | 11/853,814 | 11/853,786 |
| 11/856,694 | 11/003,463 | 11/003,701 | 11/003,683 | 11/003,614 | 11/003,702 |
| 11/003,684 | 7,246,875 | 11/003,617 | 11/764,760 | 11,853,777 | 11/293,800 |
| 11/293,802 | 11/293,801 | 11/293,808 | 11/293,809 | 11/482,975 | 11/482,970 |
| 11/482,968 | 11/482,972 | 11/482,971 | 11/482,969 | 6,431,777 | 6,334,664 |
| 6,447,113 | 7,239,407 | 6,398,359 | 6,652,089 | 6,652,090 | 7,057,759 |
| 6,631,986 | 7,187,470 | 11/315,356 | 11/501,775 | 11,744,210 | 11/859,784 |
| 6,471,331 | 6,676,250 | 6,347,864 | 6,439,704 | 6,425,700 | 6,588,952 |
| 6,626,515 | 6,722,758 | 6,871,937 | 11/060,803 | 11/097,266 | 11/097,267 |
| 11/685,084 | 11/685,086 | 11/685,090 | 11/740,925 | 11/763,444 | 11/763,443 |
| 7,249,942 | 7,206,654 | 7,162,324 | 7,162,325 | 7,231,275 | 7,146,236 |
| 10/753,475 | 10/753,499 | 6,997,698 | 7,220,112 | 7,231,276 | 10/753,440 |
| 7,220,115 | 7,195,475 | 7,144,242 | 11/499,746 | 11/501,774 | 11/525,858 |
| 11/545,501 | 11/599,335 | 11/706,380 | 11,736,545 | 11/736,554 | 11/739,047 |
| 11,749,159 | 11/739,073 | 11/775,160 | 11/853,755 | TEST | 6,786,420 |
| 6,827,282 | 6,948,661 | 7,073,713 | 10/983,060 | 7,093,762 | 7,083,108 |
| 7,222,799 | 7,201,319 | 11/442,103 | 11/739,071 | 11/518,238 | 11/518,280 |
| 11/518,244 | 11/518,243 | 11/518,242 | 7,032,899 | 6,854,724 | 11/084,237 |
| 11/084,240 | 11/084,238 | 11/357,296 | 11/357,298 | 11/357,297 | 6,350,023 |
| 6,318,849 | 6,592,207 | 6,439,699 | 6,312,114 | 11/246,676 | 11/246,677 |
| 11/246,678 | 11/246,679 | 11/246,680 | 11/246,681 | 11/246,714 | 11/246,713 |
| 11/246,689 | 11/246,671 | 11/246,670 | 11/246,669 | 11/246,704 | 11/246,710 |
| 11/246,688 | 11/246,716 | 11/246,715 | 11/246,707 | 11/246,706 | 11/246,705 |
| 11/246,708 | 11/246,693 | 11/246,692 | 11/246,696 | 11/246,695 | 11/246,694 |
| 11/482,958 | 11/482,955 | 11/482,962 | 11/482,963 | 11/482,956 | 11/482,954 |
| 11/482,974 | 11/482,957 | 11/482,987 | 11/482,959 | 11/482,960 | 11/482,961 |
| 11/482,964 | 11/482,965 | 11/482,976 | 11/482,973 | 11/495,815 | 11/495,816 |
| 11/495,817 | 10/803,074 | 10/803,073 | 7,040,823 | 10/803,076 | 10/803,077 |
| 10/803,078 | 10/803,079 | 10/922,971 | 10/922,970 | 10/922,836 | 10/922,842 |
| 10/922,848 | 10/922,843 | 7,125,185 | 7,229,226 | 11/513,386 | 11/753,559 |
| 10/815,621 | 7,243,835 | 10/815,630 | 10/815,637 | 10/815,638 | 7,251,050 |
| 10/815,642 | 7,097,094 | 7,137,549 | 10/815,618 | 7,156,292 | 11,738,974 |
| 10/815,635 | 10/815,647 | 10/815,634 | 7,137,566 | 7,131,596 | 7,128,265 |
| 7,207,485 | 7,197,374 | 7,175,089 | 10/815,617 | 10/815,620 | 7,178,719 |
| 10/815,613 | 7,207,483 | 10/815,619 | 7,270,266 | 10/815,614 | 11/446,240 |
| 11/488,162 | 11/488,163 | 11/488,164 | 11/488,167 | 11/488,168 | 11/488,165 |
| 11/488,166 | 7,267,273 | 11/834,628 | 11/839,497 | 10/815,636 | 7,128,270 |
| 11/041,650 | 11/041,651 | 11/041,652 | 11/041,649 | 11/041,610 | 11,863,253 |
| 11,863,255 | 11/863,257 | 11,863,258 | 11,863,262 | 11/041,609 | 11/041,626 |
| 11/041,627 | 11/041,624 | 11/041,625 | 11,863,268 | 11,863,269 | 11,863,270 |
| 11,863,271 | 11,863,273 | 76,584,733 | 11/041,556 | 11/041,580 | 11/041,723 |
| 11/041,698 | 11/041,648 | 11,863,263 | 11,863,264 | 11,863,265 | 11,863,266 |
| 11,863,267 | 10/815,609 | 7,150,398 | 7,159,777 | 10/815,610 | 7,188,769 |
| 7,097,106 | 7,070,110 | 7,243,849 | 11/442,381 | 11/480,957 | 11/764,694 |
| 6,227,652 | 6,213,588 | 6,213,589 | 6,231,163 | 6,247,795 | 6,394,581 |
| 6,244,691 | 6,257,704 | 6,416,168 | 6,220,694 | 6,257,705 | 6,247,794 |
| 6,234,610 | 6,247,793 | 6,264,306 | 6,241,342 | 6,247,792 | 6,264,307 |
| 6,254,220 | 6,234,611 | 6,302,528 | 6,283,582 | 6,239,821 | 6,338,547 |
| 6,247,796 | 6,557,977 | 6,390,603 | 6,362,843 | 6,293,653 | 6,312,107 |

-continued

| | | | | | |
|---|---|---|---|---|---|
| 6,227,653 | 6,234,609 | 6,238,040 | 6,188,415 | 6,227,654 | 6,209,989 |
| 6,247,791 | 6,336,710 | 6,217,153 | 6,416,167 | 6,243,113 | 6,283,581 |
| 6,247,790 | 6,260,953 | 6,267,469 | 6,588,882 | 6,742,873 | 6,918,655 |
| 6,547,371 | 6,938,989 | 6,598,964 | 6,923,526 | 6,273,544 | 6,309,048 |
| 6,420,196 | 6,443,558 | 6,439,689 | 6,378,989 | 6,848,181 | 6,634,735 |
| 6,299,289 | 6,299,290 | 6,425,654 | 6,902,255 | 6,623,101 | 6,406,129 |
| 6,505,916 | 6,457,809 | 6,550,895 | 6,457,812 | 7,152,962 | 6,428,133 |
| 7,216,956 | 7,080,895 | 11/144,844 | 7,182,437 | 11/599,341 | 11/635,533 |
| 11/607,976 | 11/607,975 | 11/607,999 | 11/607,980 | 11/607,979 | 11/607,978 |
| 11/735,961 | 11/685,074 | 11/696,126 | 11/696,144 | 11/696,650 | 11/763,446 |
| 6,224,780 | 6,235,212 | 6,280,643 | 6,284,147 | 6,214,244 | 6,071,750 |
| 6,267,905 | 6,251,298 | 6,258,285 | 6,225,138 | 6,241,904 | 6,299,786 |
| 6,866,789 | 6,231,773 | 6,190,931 | 6,248,249 | 6,290,862 | 6,241,906 |
| 6,565,762 | 6,241,905 | 6,451,216 | 6,231,772 | 6,274,056 | 6,290,861 |
| 6,248,248 | 6,306,671 | 6,331,258 | 6,110,754 | 6,294,101 | 6,416,679 |
| 6,264,849 | 6,254,793 | 6,245,246 | 6,855,264 | 6,235,211 | 6,491,833 |
| 6,264,850 | 6,258,284 | 6,312,615 | 6,228,668 | 6,180,427 | 6,171,875 |
| 6,267,904 | 6,245,247 | 6,315,914 | 7,169,316 | 6,526,658 | 7,210,767 |
| 11/056,146 | 11/635,523 | 6,665,094 | 6,450,605 | 6,512,596 | 6,654,144 |
| 7,125,090 | 6,687,022 | 7,072,076 | 7,092,125 | 7,215,443 | 7,136,195 |
| 7,077,494 | 6,877,834 | 6,969,139 | 10/636,227 | 10/636,265 | 6,912,067 |
| 7,277,205 | 7,154,637 | 10/636,230 | 7,070,251 | 6,851,782 | 10/636,211 |
| 10/636,247 | 6,843,545 | 7,079,286 | 7,064,867 | 7,065,247 | 7,027,177 |
| 7,218,415 | 7,064,873 | 6,954,276 | 7,061,644 | 7,092,127 | 7,059,695 |
| 10/990,382 | 7,177,052 | 7,270,394 | 11/124,231 | 7,188,921 | 7,187,469 |
| 7,196,820 | 11/281,445 | 11/329,041 | 7,251,051 | 7,245,399 | 11/524,911 |
| 11/640,267 | 11/706,297 | 11/730,387 | 11/737,142 | 11/764,729 | 11/834,637 |
| 11/853,019 | 11/863,239 | 11/305,274 | 11/305,273 | 11/305,275 | 11/305,152 |
| 11/305,158 | 11/305,008 | 6,231,148 | 6,293,658 | 6,614,560 | 6,238,033 |
| 6,312,070 | 6,238,111 | 6,378,970 | 6,196,739 | 6,270,182 | 6,152,619 |
| 7,006,143 | 6,876,394 | 6,738,096 | 6,970,186 | 6,287,028 | 6,412,993 |
| 11/033,145 | 11/102,845 | 11/102,861 | 11/248,421 | 11/672,878 | 7,204,941 |
| 10/815,624 | 10/815,628 | 11,845,672 | 7,278,727 | 10/913,373 | 10/913,374 |
| 10/913,372 | 7,138,391 | 7,153,956 | 10/913,380 | 10/913,379 | 10/913,376 |
| 7,122,076 | 7,148,345 | 11/172,816 | 11/172,815 | 11/172,814 | 11/482,990 |
| 11/482,986 | 11/482,985 | 11/454,899 | 11/583,942 | 11/592,990 | 11,849,360 |
| 11/831,961 | 11/831,962 | 11/831,963 | 60,951,700 | 11/832,629 | 11/832,637 |
| 60,971,535 | 10/407,212 | 7,252,366 | 10/683,064 | 10/683,041 | 7,275,811 |
| 10/884,889 | 10/922,890 | 10/922,875 | 10/922,885 | 10/922,889 | 10/922,884 |
| 10/922,879 | 10/922,887 | 10/922,888 | 10/922,874 | 7,234,795 | 10/922,871 |
| 10/922,880 | 10/922,881 | 10/922,882 | 10/922,883 | 10/922,878 | 10/922,872 |
| 10/922,876 | 10/922,886 | 10/922,877 | 7,147,792 | 7,175,774 | 11/159,193 |
| 11/491,378 | 11,766,713 | 11/841,647 | 11/482,980 | 11/563,684 | 11/482,967 |
| 11/482,966 | 11/482,988 | 11/482,989 | 11/293,832 | 11/293,838 | 11/293,825 |
| 11/293,841 | 11/293,799 | 11/293,796 | 11/293,797 | 11/293,798 | 11/124,158 |
| 11/124,196 | 11/124,199 | 11/124,162 | 11/124,202 | 11/124,197 | 11/124,154 |
| 11/124,198 | 11/124,153 | 11/124,151 | 11/124,160 | 11/124,192 | 11/124,175 |
| 11/124,163 | 11/124,149 | 11/124,152 | 11/124,173 | 11/124,155 | 7,236,271 |
| 11/124,174 | 11/124,194 | 11/124,164 | 11/124,200 | 11/124,195 | 11/124,166 |
| 11/124,150 | 11/124,172 | 11/124,165 | 11/124,186 | 11/124,185 | 11/124,184 |
| 11/124,182 | 11/124,201 | 11/124,171 | 11/124,181 | 11/124,161 | 11/124,156 |
| 11/124,191 | 11/124,159 | 11/124,176 | 11/124,188 | 11/124,170 | 11/124,187 |
| 11/124,189 | 11/124,190 | 11/124,180 | 11/124,193 | 11/124,183 | 11/124,178 |
| 11/124,177 | 11/124,148 | 11/124,168 | 11/124,167 | 11/124,179 | 11/124,169 |
| 11/187,976 | 11/188,011 | 11/188,014 | 11/482,979 | 11/735,490 | 11/853,018 |
| 11/228,540 | 11/228,500 | 11/228,501 | 11/228,530 | 11/228,490 | 11/228,531 |
| 11/228,504 | 11/228,533 | 11/228,502 | 11/228,507 | 11/228,482 | 11/228,505 |
| 11/228,497 | 11/228,487 | 11/228,529 | 11/228,484 | 11/228,489 | 11/228,518 |
| 11/228,536 | 11/228,496 | 11/228,488 | 11/228,506 | 11/228,516 | 11/228,526 |
| 11/228,539 | 11/228,538 | 11/228,524 | 11/228,523 | 11/228,519 | 11/228,528 |
| 11/228,527 | 11/228,525 | 11/228,520 | 11/228,498 | 11/228,511 | 11/228,522 |
| 11/228,515 | 11/228,537 | 11/228,534 | 11/228,491 | 11/228,499 | 11/228,509 |
| 11/228,492 | 11/228,493 | 11/228,510 | 11/228,508 | 11/228,512 | 11/228,514 |
| 11/228,494 | 11/228,495 | 11/228,486 | 11/228,481 | 11/228,477 | 11/228,485 |
| 11/228,483 | 11/228,521 | 11/228,517 | 11/228,532 | 11/228,513 | 11/228,503 |
| 11/228,480 | 11/228,535 | 11/228,478 | 11/228,479 | 6,238,115 | 6,386,535 |
| 6,398,344 | 6,612,240 | 6,752,549 | 6,805,049 | 6,971,313 | 6,899,480 |
| 6,860,664 | 6,925,935 | 6,966,636 | 7,024,995 | 10/636,245 | 6,926,455 |
| 7,056,038 | 6,869,172 | 7,021,843 | 6,988,845 | 6,964,533 | 6,981,809 |
| 11/060,804 | 7,258,067 | 11/155,544 | 7,222,941 | 11/206,805 | 11/281,421 |
| 7,249,904 | 11/737,726 | 11,772,240 | 11/863,246 | 11/863,145 | 11/865,650 |
| 6,087,638 | 6,340,222 | 6,041,600 | 6,299,300 | 6,067,797 | 6,286,935 |
| 6,044,646 | 6,382,769 | 10/868,866 | 6,787,051 | 6,938,990 | 11/242,916 |
| 11/242,917 | 11/144,799 | 11/198,235 | 11,861,282 | 11,861,284 | 11/766,052 |
| 7,152,972 | 11/592,996 | D529952 | 6,390,605 | 6,322,195 | 6,612,110 |
| 6,480,089 | 6,460,778 | 6,305,788 | 6,426,014 | 6,364,453 | 6,457,795 |
| 6,315,399 | 6,338,548 | 7,040,736 | 6,938,992 | 6,994,425 | 6,863,379 |
| 6,540,319 | 6,994,421 | 6,984,019 | 7,008,043 | 6,997,544 | 6,328,431 |
| 6,991,310 | 10/965,772 | 7,140,723 | 6,328,425 | 6,982,184 | 7,267,423 |
| 7,134,741 | 7,066,577 | 7,152,945 | 11/038,200 | 7,021,744 | 6,991,320 |

-continued

| | | | | | |
|---|---|---|---|---|---|
| 7,155,911 | 11/107,799 | 6,595,624 | 7,152,943 | 7,125,103 | 11/209,709 |
| 11/228,407 | 11/273,271 | 7,229,151 | 11/330,058 | 7,237,873 | 11/329,163 |
| 11/442,180 | 11/450,431 | 7,213,907 | 6,417,757 | 11/482,951 | 11/545,566 |
| 11/583,826 | 11/604,315 | 11/604,323 | 11/643,845 | 11/706,950 | 11/730,399 |
| 11,749,121 | 11/753,549 | 11/834,630 | | 7,095,309 | 6,854,825 |
| 6,623,106 | 6,672,707 | 6,575,561 | 6,817,700 | 6,588,885 | 7,075,677 |
| 6,428,139 | 6,575,549 | 6,846,692 | 6,425,971 | 7,063,993 | 6,383,833 |
| 6,955,414 | 6,412,908 | 6,746,105 | 6,953,236 | 6,412,904 | 7,128,388 |
| 6,398,343 | 6,652,071 | 6,793,323 | 6,659,590 | 6,676,245 | 7,201,460 |
| 6,464,332 | 6,659,593 | 6,478,406 | 6,978,613 | 6,439,693 | 6,502,306 |
| 6,966,111 | 6,863,369 | 6,428,142 | 6,874,868 | 6,390,591 | 6,799,828 |
| 6,896,358 | 7,018,016 | 10/296,534 | 6,328,417 | 6,322,194 | 6,382,779 |
| 6,629,745 | 6,565,193 | 6,609,786 | 6,609,787 | 6,439,908 | 6,684,503 |
| 6,843,551 | 6,764,166 | 6,561,617 | 10/510,092 | 6,557,970 | 6,546,628 |
| 10/510,098 | 6,652,074 | 6,820,968 | 7,175,260 | 6,682,174 | 10/510,207 |
| 6,648,453 | 6,834,932 | 6,682,176 | 6,998,062 | 6,767,077 | 10/534,830 |
| 6,755,509 | 10/534,813 | 6,692,108 | 10/534,811 | 6,672,709 | 10/534,823 |
| 7,086,718 | 10/534,881 | 6,672,710 | 10/534,812 | 6,669,334 | 10/534,804 |
| 7,152,958 | 10/534,817 | 6,824,246 | 7,264,336 | 6,669,333 | 10/534,815 |
| 6,820,967 | 10/534,883 | 6,736,489 | 7,264,335 | 6,719,406 | 7,222,943 |
| 7,188,419 | 7,168,166 | 6,974,209 | 7,086,719 | 6,974,210 | 7,195,338 |
| 7,252,775 | 7,101,025 | 11/474,281 | 11/485,258 | 11/706,304 | 11/706,324 |
| 11/706,326 | 11/706,321 | 11/772,239 | 11/782,598 | 11/829,941 | 11/852,991 |
| 11,852,986 | 11/763,440 | 11/763,442 | 11/246,687 | 11/246,718 | 11/246,685 |
| 11/246,686 | 11/246,703 | 11/246,691 | 11/246,711 | 11/246,690 | 11/246,712 |
| 11/246,717 | 11/246,709 | 11/246,700 | 11/246,701 | 11/246,702 | 11/246,668 |
| 11/246,697 | 11/246,698 | 11/246,699 | 11/246,675 | 11/246,674 | 11/246,667 |
| 11/829,957 | 11/829,960 | 11/829,961 | 11/829,962 | 11/829,963 | 11/829,966 |
| 11/829,967 | 11/829,968 | 11/829,969 | 7,156,508 | 7,159,972 | 7,083,271 |
| 7,165,834 | 7,080,894 | 7,201,469 | 7,090,336 | 7,156,489 | 10/760,233 |
| 10/760,246 | 7,083,257 | 7,258,422 | 7,255,423 | 7,219,980 | 10/760,253 |
| 10/760,255 | 10/760,209 | 7,118,192 | 10/760,194 | 10/760,238 | 7,077,505 |
| 7,198,354 | 7,077,504 | 10/760,189 | 7,198,355 | 10/760,232 | 10/760,231 |
| 7,152,959 | 7,213,906 | 7,178,901 | 7,222,938 | 7,108,353 | 7,104,629 |
| 11/446,227 | 11/454,904 | 11/472,345 | 11/474,273 | 7,261,401 | 11/474,279 |
| 11/482,939 | 11/482,950 | 11/499,709 | 11/592,984 | 11/601,668 | 11/603,824 |
| 11/601,756 | 11/601,672 | 11/650,546 | 11/653,253 | 11/706,328 | 11/706,299 |
| 11/706,965 | 11/737,080 | 11/737,041 | 11/778,062 | 11/778,566 | 11/782,593 |
| 11/246,684 | 11/246,672 | 11/246,673 | 11/246,683 | 11/246,682 | 60/939,086 |
| 11,860,538 | 11,860,539 | 11/860,540 | 11,860,541 | 11,860,542 | 7,246,886 |
| 7,128,400 | 7,108,355 | 6,991,322 | 10/728,790 | 7,118,197 | 10/728,784 |
| 10/728,783 | 7,077,493 | 6,962,402 | 10/728,803 | 7,147,308 | 10/728,779 |
| 7,118,198 | 7,168,790 | 7,172,270 | 7,229,155 | 6,830,318 | 7,195,342 |
| 7,175,261 | 10/773,183 | 7,108,356 | 7,118,202 | 10/773,186 | 7,134,744 |
| 10/773,185 | 7,134,743 | 7,182,439 | 7,210,768 | 10/773,187 | 7,134,745 |
| 7,156,484 | 7,118,201 | 7,111,926 | 10/773,184 | 7,018,021 | 11/060,751 |
| 11/060,805 | 11/188,017 | 7,128,402 | 11/298,774 | 11/329,157 | 11/490,041 |
| 11/501,767 | 11/499,736 | 7,246,885 | 7,229,156 | 11/505,846 | 11/505,857 |
| 11/505,856 | 11/524,908 | 11/524,938 | 7,258,427 | 11/524,912 | 11/592,999 |
| 11/592,995 | 11/603,825 | 11/649,773 | 11/650,549 | 11/653,237 | 11/706,378 |
| 11/706,962 | 11,749,118 | 11/754,937 | 11,749,120 | 11/744,885 | 11/779,850 |
| 11/765,439 | 11/842,950 | 11/839,539 | 11/097,308 | 11/097,309 | 7,246,876 |
| 11/097,299 | 11/097,310 | 11/097,213 | 11/210,687 | 11/097,212 | 7,147,306 |
| 7,261,394 | 11/764,806 | 11/782,595 | 11/482,953 | 11/482,977 | 11/544,778 |
| 11/544,779 | 11/764,808 | 11/756,624 | 11/756,625 | 11/756,626 | 11/756,627 |
| 11/756,628 | 11/756,629 | 11/756,630 | 11/756,631 | 7,156,289 | 7,178,718 |
| 7,225,979 | 11/712,434 | 11/084,796 | 11/084,742 | 11/084,806 | 09/575,197 |
| 09/575,197 | 7,079,712 | 7,079,712 | 6,825,945 | 6,825,945 | 09/575,165 |
| 09/575,165 | 6,813,039 | 6,813,039 | 7,190,474 | 6,987,506 | 6,987,506 |
| 6,824,044 | 7,038,797 | 7,038,797 | 6,980,318 | 6,980,318 | 6,816,274 |
| 6,816,274 | 7,102,772 | 7,102,772 | 09/575,186 | 09/575,186 | 6,681,045 |
| 6,681,045 | 6,678,499 | 6,679,420 | 6,963,845 | 6,976,220 | 6,728,000 |
| 6,728,000 | 7,110,126 | 7,173,722 | 7,173,722 | 6,976,035 | 6,813,558 |
| 6,766,942 | 6,965,454 | 6,995,859 | 7,088,459 | 7,088,459 | 6,720,985 |
| 09/609,303 | 6,922,779 | 6,978,019 | 6,847,883 | 7,131,058 | 09/721,895 |
| 09/607,843 | 09/693,690 | 6,959,298 | 6,973,450 | 7,150,404 | 6,965,882 |
| 7,233,924 | 09/575,181 | 09/575,181 | 09/722,174 | 7,175,079 | 7,162,259 |
| 6,718,061 | 10/291,523 | 10/291,471 | 7,012,710 | 6,825,956 | 10/291,481 |
| 7,222,098 | 10/291,825 | 7,263,508 | 7,031,010 | 6,972,864 | 6,862,105 |
| 7,009,738 | 6,989,911 | 6,982,807 | 10/291,576 | 6,829,387 | 6,714,678 |
| 6,644,545 | 6,609,653 | 6,651,879 | 10/291,555 | 10/291,510 | 10/291,592 |
| 10/291,542 | 7,044,363 | 7,004,390 | 6,867,880 | 7,034,953 | 6,987,581 |
| 7,216,224 | 10/291,821 | 7,162,269 | 7,162,222 | 10/291,822 | 10/291,524 |
| 10/291,553 | 6,850,931 | 6,865,570 | 6,847,961 | 10/685,523 | 10/685,583 |
| 7,162,442 | 10/685,584 | 7,159,784 | 10/804,034 | 10/793,933 | 6,889,896 |
| 10/831,232 | 7,174,056 | 6,996,274 | 7,162,088 | 10/943,874 | 10/943,872 |
| 10/944,044 | 7,259,884 | 10/944,043 | 7,167,270 | 10/943,877 | 6,986,459 |
| 10/954,170 | 7,181,448 | 10/981,626 | 10/981,616 | 10/981,627 | 7,231,293 |
| 7,174,329 | 10/992,713 | 11/006,536 | 7,200,591 | 11/020,106 | 11/020,260 |
| 11/020,321 | 11/020,319 | 11/026,045 | 11/059,696 | 11/051,032 | 11/059,674 |

-continued

| | | | | | |
|---|---|---|---|---|---|
| 11/107,944 | 11/107,941 | 11/082,940 | 11/082,815 | 11/082,827 | 11/082,829 |
| 6,991,153 | 6,991,154 | 11/124,256 | 11/123,136 | 11/154,676 | 11/159,196 |
| 11/182,002 | 11/202,251 | 11/202,252 | 11/202,253 | 11/203,200 | 11/202,218 |
| 11/206,778 | 11/203,424 | 11/222,977 | 11/228,450 | 11/227,239 | 11/286,334 |
| 7,225,402 | 11/329,187 | 11/349,143 | 11/491,225 | 11/491,121 | 11/442,428 |
| 11/454,902 | 11/442,385 | 11/478,590 | 7,271,931 | 11/520,170 | 11/603,057 |
| 11/706,964 | 11/739,032 | 11,739,014 | 11/834,633 | 11/830,848 | 11/830,849 |
| 11/839,542 | 11/866,394 | 7,068,382 | 7,068,382 | 7,007,851 | 6,957,921 |
| 6,457,883 | 10/743,671 | 7,044,381 | 11/203,205 | 7,094,910 | 7,091,344 |
| 7,122,685 | 7,038,066 | 7,099,019 | 7,062,651 | 7,062,651 | 6,789,194 |
| 6,789,194 | 6,789,191 | 6,789,191 | 10/900,129 | 7,278,018 | 10/913,350 |
| 10/982,975 | 10/983,029 | 11/331,109 | 6,644,642 | 6,644,642 | 6,502,614 |
| 6,502,614 | 6,622,999 | 6,622,999 | 6,669,385 | 6,669,385 | 6,827,116 |
| 7,011,128 | 10/949,307 | 6,549,935 | 6,549,935 | 6,987,573 | 6,987,573 |
| 6,727,996 | 6,727,996 | 6,591,884 | 6,591,884 | 6,439,706 | 6,439,706 |
| 6,760,119 | 6,760,119 | 09/575,198 | 09/575,198 | 7,064,851 | 6,826,547 |
| 6,290,349 | 6,290,349 | 6,428,155 | 6,428,155 | 6,785,016 | 6,785,016 |
| 6,831,682 | 6,741,871 | 6,927,871 | 6,980,306 | 6,965,439 | 6,840,606 |
| 7,036,918 | 6,977,746 | 6,970,264 | 7,068,389 | 7,093,991 | 7,190,491 |
| 10/901,154 | 10/932,044 | 10/962,412 | 7,177,054 | 10/962,552 | 10/965,733 |
| 10/965,933 | 10/974,742 | 10/982,974 | 7,180,609 | 10/986,375 | 11/107,817 |
| 11/148,238 | 11/149,160 | 11/206,756 | 11/250,465 | 7,202,959 | 11/653,219 |
| 11/706,309 | 11/730,389 | 11/730,392 | 60/953,443 | 11/866,387 | 60,974,077 |
| 6,982,798 | 6,870,966 | 6,870,966 | 6,822,639 | 6,822,639 | 6,474,888 |
| 6,627,870 | 6,724,374 | 6,788,982 | 7,263,270 | 6,788,293 | 6,946,672 |
| 6,737,591 | 6,737,591 | 7,091,960 | 09/693,514 | 6,792,165 | 7,105,753 |
| 6,795,593 | 6,980,704 | 6,768,821 | 7,132,612 | 7,041,916 | 6,797,895 |
| 7,015,901 | 10/782,894 | 7,148,644 | 10/778,056 | 10/778,058 | 10/778,060 |
| 10/778,059 | 10/778,063 | 10/778,062 | 10/778,061 | 10/778,057 | 7,096,199 |
| 10/917,468 | 10/917,467 | 10/917,466 | 10/917,465 | 7,218,978 | 7,245,294 |
| 7,277,085 | 7,187,370 | 10/917,436 | 10/943,856 | 10/919,379 | 7,019,319 |
| 10/943,878 | 10/943,849 | 7,043,096 | 7,148,499 | 11/144,840 | 11/155,556 |
| 11/155,557 | 11/193,481 | 11/193,435 | 11/193,482 | 11/193,479 | 11/255,941 |
| 11/281,671 | 11/298,474 | 7,245,760 | 11/488,832 | 11/495,814 | 11/495,823 |
| 11/495,822 | 11/495,821 | 11/495,820 | 11/653,242 | 11/754,370 | 60,911,260 |
| 11/829,936 | 11/839,494 | 11,866,305 | 11,866,313 | 11,866,324 | 11,866,336 |
| 11,866,348 | 11,866,359 | 7,055,739 | 7,055,739 | 7,233,320 | 7,233,320 |
| 6,830,196 | 6,830,196 | 6,832,717 | 6,832,717 | 7,182,247 | 7,120,853 |
| 7,082,562 | 6,843,420 | 10/291,718 | 6,789,731 | 7,057,608 | 6,766,944 |
| 6,766,945 | 10/291,715 | 10/291,559 | 10/291,660 | 7,264,173 | 10/409,864 |
| 7,108,192 | 10/537,159 | 7,111,791 | 7,077,333 | 6,983,878 | 10/786,631 |
| 7,134,598 | 10/893,372 | 6,929,186 | 6,994,264 | 7,017,826 | 7,014,123 |
| 7,134,601 | 7,150,396 | 10/971,146 | 7,017,823 | 7,025,276 | 10/990,459 |
| 7,080,780 | 11/074,802 | 11/442,366 | 11,749,158 | 11/842,948 | 10/492,169 |
| 10/492,152 | 10/492,168 | 10/492,161 | 10/492,154 | 10/502,575 | 10/531,229 |
| 10/683,151 | 10/531,733 | 10/683,040 | 10/510,391 | 10/510,392 | 10/778,090 |
| 6,957,768 | 6,957,768 | 09/575,172 | 09/575,172 | 7,170,499 | 7,170,499 |
| 7,106,888 | 7,106,888 | 7,123,239 | 7,123,239 | 6,982,701 | 6,982,703 |
| 7,227,527 | 6,786,397 | 6,947,027 | 6,975,299 | 7,139,431 | 7,048,178 |
| 7,118,025 | 6,839,053 | 7,015,900 | 7,010,147 | 7,133,557 | 6,914,593 |
| 10/291,546 | 6,938,826 | 7,278,566 | 7,123,245 | 6,992,662 | 7,190,346 |
| 11/074,800 | 11/074,782 | 11/074,777 | 11/075,917 | 7,221,781 | 11/102,843 |
| 7,213,756 | 11/188,016 | 7,180,507 | 7,263,225 | 11/442,114 | 11/737,094 |
| 11/753,570 | 11/782,596 | 11/865,711 | 11,856,061 | 11,856,062 | 11,856,064 |
| 11,856,066 | 11/672,522 | 11/672,950 | 11/672,947 | 11/672,891 | 11/672,954 |
| 11/672,533 | 11,754,310 | 11/754,321 | 11/754,320 | 11/754,319 | 11/754,318 |
| 11/754,317 | 11/754,316 | 11/754,315 | 11/754,314 | 11/754,313 | 11/754,312 |
| 11/754,311 | 6,593,166 | 7,132,679 | 6,940,088 | 7,119,357 | 11/513,077 |
| 6,755,513 | 6,974,204 | 6,409,323 | 7,055,930 | 6,281,912 | 6,893,109 |
| 6,604,810 | 6,824,242 | 6,318,920 | 7,210,867 | 6,488,422 | 6,655,786 |
| 6,457,810 | 6,485,135 | 6,796,731 | 6,904,678 | 6,641,253 | 7,125,106 |
| 6,786,658 | 7,097,273 | 6,824,245 | 7,222,947 | 6,918,649 | 6,860,581 |
| 6,929,351 | 7,063,404 | 6,969,150 | 7,004,652 | 6,871,938 | 6,905,194 |
| 6,846,059 | 6,997,626 | 10/974,881 | 7,029,098 | 6,966,625 | 7,114,794 |
| 7,207,646 | 7,077,496 | 11/071,117 | 11/072,529 | 7,152,938 | 7,182,434 |
| 7,182,430 | 11/102,842 | 7,032,993 | 11/155,513 | 11/155,545 | 11/144,813 |
| 7,172,266 | 7,258,430 | 7,128,392 | 7,210,866 | 11/488,066 | 11/505,933 |
| 11/540,727 | 11/635,480 | 11/707,946 | 11/706,303 | 11/709,084 | 11/730,776 |
| 11/744,143 | 11/779,845 | 11/782,589 | 11/863,256 | 11/066,161 | 11/066,160 |
| 11/066,159 | 11/066,158 | 11/066,165 | 6,804,030 | 6,807,315 | 6,771,811 |
| 6,683,996 | 7,271,936 | 10/934,490 | 6,965,691 | 7,058,219 | 10/943,977 |
| 7,187,807 | 7,181,063 | 11/338,783 | 11/603,823 | 11/650,536 | 10/727,181 |
| 10/727,162 | 10/727,163 | 10/727,245 | 7,121,639 | 7,165,824 | 7,152,942 |
| 10/727,157 | 7,181,572 | 7,096,137 | 10/727,257 | 7,278,034 | 7,188,282 |
| 10/727,159 | 10/727,180 | 10/727,179 | 10/727,192 | 10/727,274 | 10/727,164 |
| 10/727,161 | 10/727,198 | 10/727,158 | 10/754,536 | 10/754,938 | 10/727,227 |
| 10/727,160 | 10/934,720 | 7,171,323 | 7,278,697 | 11/442,131 | 11/474,278 |
| 11/488,853 | 11/488,841 | 11,749,750 | 11,749,749 | 10/296,522 | 6,795,215 |
| 7,070,098 | 7,154,638 | 6,805,419 | 6,859,289 | 6,977,751 | 6,398,332 |
| 6,394,573 | 6,622,923 | 6,747,760 | 6,921,144 | 10/884,881 | 7,092,112 |

-continued

| | | | | | |
|---|---|---|---|---|---|
| 7,192,106 | 11/039,866 | 7,173,739 | 6,986,560 | 7,008,033 | 11/148,237 |
| 7,222,780 | 7,270,391 | 7,150,510 | 11/478,599 | 11/499,749 | 11/521,388 |
| 11/738,518 | 11/482,981 | 11/743,662 | 11/743,661 | 11/743,659 | 11/743,655 |
| 11/743,657 | 11/752,900 | 7,195,328 | 7,182,422 | 11/650,537 | 11/712,540 |
| 10/854,521 | 10/854,522 | 10/854,488 | 10/854,487 | 10/854,503 | 10/854,504 |
| 10/854,509 | 7,188,928 | 7,093,989 | 10/854,497 | 10/854,495 | 10/854,498 |
| 10/854,511 | 10/854,512 | 10/854,525 | 10/854,526 | 10/854,516 | 10/854,508 |
| 7,252,353 | 10/854,515 | 7,267,417 | 10/854,505 | 10/854,493 | 7,275,805 |
| 10/854,489 | 10/854,490 | 10/854,492 | 10/854,491 | 10/854,528 | 10/854,523 |
| 10/854,527 | 10/854,524 | 10/854,520 | 10/854,514 | 10/854,519 | 10/854,513 |
| 10/854,499 | 10/854,501 | 7,266,661 | 7,243,193 | 10/854,518 | 10/854,517 |
| 10/934,628 | 7,163,345 | 11/499,803 | 11/601,757 | 11/706,295 | 11/735,881 |
| 11,748,483 | 11,749,123 | 11/766,061 | 11,775,135 | 11,772,235 | 11/778,569 |
| 11/829,942 | 11/014,731 | D529081 | D541848 | D528597 | 6,924,907 |
| 6,712,452 | 6,416,160 | 6,238,043 | 6,958,826 | 6,812,972 | 6,553,459 |
| 6,967,741 | 6,956,669 | 6,903,766 | 6,804,026 | 7,259,889 | 6,975,429 |
| 10/636,234 | 10/636,233 | 10/636,217 | 10/636,216 | 7,274,485 | 7,139,084 |
| 7,173,735 | 7,068,394 | 10/636,276 | 7,086,644 | 7,250,977 | 7,146,281 |
| 7,023,567 | 7,136,183 | 7,083,254 | 6,796,651 | 7,061,643 | 7,057,758 |
| 6,894,810 | 6,995,871 | 7,085,010 | 7,092,126 | 7,123,382 | 7,061,650 |
| 10/853,143 | 6,986,573 | 6,974,212 | 10/943,907 | 7,173,737 | 10/954,168 |
| 7,246,868 | 11/065,357 | 7,137,699 | 11/107,798 | 7,148,994 | 7,077,497 |
| 11/176,372 | 7,248,376 | 11/225,158 | 11/225,154 | 7,173,729 | 11/442,132 |
| 11/478,607 | 11/503,085 | 11/545,502 | 11/583,943 | 11/585,946 | 11/653,239 |
| 11/653,238 | 11/764,781 | 11/764,782 | 11/779,884 | 11,845,666 | 11/544,764 |
| 11/544,765 | 11/544,772 | 11/544,773 | 11/544,774 | 11/544,775 | 11/544,776 |
| 11/544,766 | 11/544,767 | 11/544,771 | 11/544,770 | 11/544,769 | 11/544,777 |
| 11/544,768 | 11/544,763 | 11/293,804 | 11/293,840 | 11/293,803 | 11/293,833 |
| 11/293,834 | 11/293,835 | 11/293,836 | 11/293,837 | 11/293,792 | 11/293,794 |
| 11/293,839 | 11/293,826 | 11/293,829 | 11/293,830 | 11/293,827 | 11/293,828 |
| 7,270,494 | 11/293,823 | 11/293,824 | 11/293,831 | 11/293,815 | 11/293,819 |
| 11/293,818 | 11/293,817 | 11/293,816 | 11/838,875 | 11/482,978 | 11/640,356 |
| 11/640,357 | 11/640,358 | 11/640,359 | 11/640,360 | 11/640,355 | 11/679,786 |
| 10/760,254 | 10/760,210 | 10/760,202 | 7,201,468 | 10/760,198 | 10/760,249 |
| 7,234,802 | 10/760,196 | 10/760,247 | 7,156,511 | 10/760,264 | 7,258,432 |
| 7,097,291 | 10/760,222 | 10/760,248 | 7,083,273 | 10/760,192 | 10/760,203 |
| 10/760,204 | 10/760,205 | 10/760,206 | 10/760,267 | 10/760,270 | 7,198,352 |
| 10/760,271 | 10/760,275 | 7,201,470 | 7,121,655 | 10/760,184 | 7,232,208 |
| 10/760,186 | 10/760,261 | 7,083,272 | 7,261,400 | 11/474,272 | 11/474,315 |
| 11/501,771 | 11/583,874 | 11/650,554 | 11/706,322 | 11/706,968 | 11/749,119 |
| 11,749,157 | 11,779,848 | 11/782,590 | 11/855,152 | 11,855,151 | 11/014,764 |
| 11/014,763 | 11/014,748 | 11/014,747 | 11/014,761 | 11/014,760 | 11/014,757 |
| 11/014,714 | 7,249,822 | 11/014,762 | 11/014,724 | 11/014,723 | 11/014,756 |
| 11/014,736 | 11/014,759 | 11/014,758 | 11/014,725 | 11/014,739 | 11/014,738 |
| 11/014,737 | 11/014,726 | 11/014,745 | 11/014,712 | 7,270,405 | 11/014,751 |
| 11/014,735 | 11/014,734 | 11/014,719 | 11/014,750 | 11/014,749 | 7,249,833 |
| 11/758,640 | 11/775,143 | 11/838,877 | 11/014,769 | 11/014,729 | 11/014,743 |
| 11/014,733 | 11/014,754 | 11/014,755 | 11/014,765 | 11/014,766 | 11/014,740 |
| 11/014,720 | 11/014,753 | 7,255,430 | 11/014,744 | 11/014,741 | 11/014,768 |
| 11/014,767 | 11/014,718 | 11/014,717 | 11/014,716 | 11/014,732 | 11/014,742 |
| 11/097,268 | 11/097,185 | 11/097,184 | 11/778,567 | 11,852,958 | 11,852,907 |
| 11/293,820 | 11/293,813 | 11/293,822 | 11/293,812 | 11/293,821 | 11/293,814 |
| 11/293,793 | 11/293,842 | 11/293,811 | 11/293,807 | 11/293,806 | 11/293,805 |
| 11/293,810 | 11/688,863 | 11/688,864 | 11/688,865 | 11/688,866 | 11/688,867 |
| 11/688,868 | 11/688,869 | 11/688,871 | 11/688,872 | 11/688,873 | 11/741,766 |
| 11/482,982 | 11/482,983 | 11/482,984 | 11/495,818 | 11/495,819 | 11/677,049 |
| 11/677,050 | 11/677,051 | 11/014,722 | D528156 | 10/760,180 | 7,111,935 |
| 10/760,213 | 10/760,219 | 10/760,237 | 7,261,482 | 10/760,220 | 7,002,664 |
| 10/760,252 | 10/760,265 | 7,088,420 | 11/446,233 | 11/503,083 | 11/503,081 |
| 11/516,487 | 11/599,312 | 6,364,451 | 6,533,390 | 6,454,378 | 7,224,478 |
| 6,559,969 | 6,896,362 | 7,057,760 | 6,982,799 | 11/202,107 | 11/743,672 |
| 11,744,126 | 11/743,673 | 7,093,494 | 7,143,652 | 7,089,797 | 7,159,467 |
| 7,234,357 | 7,124,643 | 7,121,145 | 7,089,790 | 7,194,901 | 6,968,744 |
| 7,089,798 | 7,240,560 | 7,137,302 | 11/442,177 | 7,171,855 | 7,260,995 |
| 7,260,993 | 7,165,460 | 7,222,538 | 7,258,019 | 11/543,047 | 7,258,020 |
| 11/604,324 | 11/642,520 | 11/706,305 | 11/707,056 | 11,744,211 | 11/767,526 |
| 11/779,846 | 11/764,227 | 11/829,943 | 11/829,944 | 6,454,482 | 6,808,330 |
| 6,527,365 | 6,474,773 | 6,550,997 | 7,093,923 | 6,957,923 | 7,131,724 |
| 10/949,288 | 7,168,867 | 7,125,098 | 11/706,966 | 11/185,722 | 7,249,901 |
| 7,188,930 | 11/014,728 | 11/014,727 | D536031 | D531214 | 7,237,888 |
| 7,168,654 | 7,201,272 | 6,991,098 | 7,217,051 | 6,944,970 | 10/760,215 |
| 7,108,434 | 10/760,257 | 7,210,407 | 7,186,042 | 10/760,266 | 6,920,704 |
| 7,217,049 | 10/760,214 | 10/760,260 | 7,147,102 | 10/760,269 | 7,249,838 |
| 10/760,241 | 10/962,413 | 10/962,427 | 7,261,477 | 7,225,739 | 10/962,402 |
| 10/962,425 | 10/962,428 | 7,191,978 | 10/962,426 | 10/962,409 | 10/962,417 |
| 10/962,403 | 7,163,287 | 7,258,415 | 10/962,523 | 7,258,424 | 10/962,410 |
| 7,195,412 | 7,207,670 | 7,270,401 | 7,220,072 | 11/474,267 | 11/544,547 |
| 11/585,925 | 11/593,000 | 11/706,298 | 11/706,296 | 11/706,327 | 11/730,760 |
| 11/730,407 | 11/730,787 | 11/735,977 | 11/736,527 | 11/753,566 | 11/754,359 |
| 11/778,061 | 11/765,398 | 11/778,556 | 11/829,937 | 11/780,470 | 11/866,399 |

-continued

| | | | | | |
|---|---|---|---|---|---|
| 11/223,262 | 11/223,018 | 11/223,114 | 11/223,022 | 11/223,021 | 11/223,020 |
| 11/223,019 | 11/014,730 | D541849 | 29/279,123 | 6,716,666 | 6,949,217 |
| 6,750,083 | 7,014,451 | 6,777,259 | 6,923,524 | 6,557,978 | 6,991,207 |
| 6,766,998 | 6,967,354 | 6,759,723 | 6,870,259 | 10/853,270 | 6,925,875 |
| 10/898,214 | 7,095,109 | 7,145,696 | 10/976,081 | 7,193,482 | 7,134,739 |
| 7,222,939 | 7,164,501 | 7,118,186 | 7,201,523 | 7,226,159 | 7,249,839 |
| 7,108,343 | 7,154,626 | 7,079,292 | 10/980,184 | 7,233,421 | 7,063,408 |
| 10/983,082 | 10/982,804 | 7,032,996 | 10/982,834 | 10/982,833 | 10/982,817 |
| 7,217,046 | 6,948,870 | 7,195,336 | 7,070,257 | 10/986,813 | 10/986,785 |
| 7,093,922 | 6,988,789 | 10/986,788 | 7,246,871 | 10/992,748 | 10/992,747 |
| 7,187,468 | 10/992,828 | 7,196,814 | 10/992,754 | 7,268,911 | 7,265,869 |
| 7,128,384 | 7,164,505 | 11/003,595 | 7,025,434 | 11/003,481 | 11/003,485 |
| 7,206,098 | 7,265,877 | 7,193,743 | 7,168,777 | 11/006,734 | 7,195,329 |
| 7,198,346 | 11/006,739 | 11/013,363 | 11/013,881 | 6,959,983 | 7,128,386 |
| 7,097,104 | 11/013,636 | 7,083,261 | 7,070,258 | 7,083,275 | 7,110,139 |
| 6,994,419 | 6,935,725 | 11/026,046 | 7,178,892 | 7,219,429 | 6,988,784 |
| 11/026,135 | 11/026,326 | 11/064,005 | 11/064,006 | 7,178,903 | 7,273,274 |
| 7,083,256 | 11/064,008 | 11/064,009 | 11/064,013 | 6,974,206 | 11/064,004 |
| 7,066,588 | 7,222,940 | 11/075,918 | 7,018,025 | 7,221,867 | 11/072,517 |
| 7,188,938 | 7,021,742 | 7,083,262 | 7,192,119 | 11/083,021 | 7,036,912 |
| 7,175,256 | 7,182,441 | 7,083,258 | 7,114,796 | 7,147,302 | 11/084,757 |
| 7,219,982 | 7,118,195 | 7,229,153 | 6,991,318 | 7,108,346 | 11/248,429 |
| 11/239,031 | 7,178,899 | 7,066,579 | 11/281,419 | 11/298,633 | 11/329,188 |
| 11/329,140 | 7,270,397 | 7,258,425 | 7,237,874 | 7,152,961 | 11/478,592 |
| 7,207,658 | 11/484,744 | 11/488,867 | 7,207,659 | 11/525,857 | 11/540,569 |
| 11/583,869 | 11/592,985 | 11/601,762 | 11/604,316 | 11/604,309 | 11/604,303 |
| 11/643,844 | 11/650,553 | 11/655,940 | 11/653,320 | 11/706,294 | 11/706,381 |
| 11/706,323 | 11/706,963 | 11/713,660 | 11/730,408 | 11/696,186 | 11/730,390 |
| 11/737,139 | 11/737,749 | 11/740,273 | 11,749,122 | 11/754,361 | 11,766,043 |
| 11/764,775 | 11/768,872 | 11/775,156 | 11/779,271 | 11/779,272 | 11/829,938 |
| 11/839,502 | 11,858,852 | 9628 | 5382 | 6,485,123 | 6,425,657 |
| 6,488,358 | 7,021,746 | 6,712,986 | 6,981,757 | 6,505,912 | 6,439,694 |
| 6,364,461 | 6,378,990 | 6,425,658 | 6,488,361 | 6,814,429 | 6,471,336 |
| 6,457,813 | 6,540,331 | 6,454,396 | 6,464,325 | 6,443,559 | 6,435,664 |
| 6,412,914 | 6,488,360 | 6,550,896 | 6,439,695 | 6,447,100 | 09/900,160 |
| 6,488,359 | 6,637,873 | 10/485,738 | 6,618,117 | 10/485,737 | 6,803,989 |
| 7,234,801 | 7,044,589 | 7,163,273 | 6,416,154 | 6,547,364 | 10/485,744 |
| 6,644,771 | 7,152,939 | 6,565,181 | 10/485,805 | 6,857,719 | 7,255,414 |
| 6,702,417 | 10/485,652 | 6,918,654 | 7,070,265 | 6,616,271 | 6,652,078 |
| 6,503,408 | 6,607,263 | 7,111,924 | 6,623,108 | 6,698,867 | 6,488,362 |
| 6,625,874 | 6,921,153 | 7,198,356 | 6,536,874 | 6,425,651 | 6,435,667 |
| 10/509,997 | 6,527,374 | 10/510,154 | 6,582,059 | 10/510,152 | 6,513,908 |
| 7,246,883 | 6,540,332 | 6,547,368 | 7,070,256 | 6,508,546 | 10/510,151 |
| 6,679,584 | 10/510,000 | 6,857,724 | 10/509,998 | 6,652,052 | 10/509,999 |
| 6,672,706 | 10/510,096 | 6,688,719 | 6,712,924 | 6,588,886 | 7,077,508 |
| 7,207,654 | 6,935,724 | 6,927,786 | 6,988,787 | 6,899,415 | 6,672,708 |
| 6,644,767 | 6,874,866 | 6,830,316 | 6,994,420 | 6,954,254 | 7,086,720 |
| 7,240,992 | 7,267,424 | 7,128,397 | 7,084,951 | 7,156,496 | 7,066,578 |
| 7,101,023 | 11/165,027 | 11/202,235 | 11/225,157 | 7,159,965 | 7,255,424 |
| 11/349,519 | 7,137,686 | 7,201,472 | 11/442,413 | 11/504,602 | 7,216,957 |
| 11/520,572 | 11/583,858 | 11/583,895 | 11/585,976 | 11/635,488 | 11/653,314 |
| 11/706,952 | 11/706,307 | 11/785,109 | 11/740,287 | 11/754,367 | 11/758,643 |
| 11/778,572 | 11,859,791 | 11/863,260 | 6,916,082 | 6,786,570 | 10/753,478 |
| 6,848,780 | 6,966,633 | 7,179,395 | 6,969,153 | 6,979,075 | 7,132,056 |
| 6,832,828 | 6,860,590 | 6,905,620 | 6,786,574 | 6,824,252 | 7,097,282 |
| 6,997,545 | 6,971,734 | 6,918,652 | 6,978,990 | 6,863,105 | 10/780,624 |
| 7,194,629 | 10/791,792 | 6,890,059 | 6,988,785 | 6,830,315 | 7,246,881 |
| 7,125,102 | 7,028,474 | 7,066,575 | 6,986,202 | 7,044,584 | 7,210,762 |
| 7,032,992 | 7,140,720 | 7,207,656 | 11/031,084 | 11/048,748 | 7,008,041 |
| 7,011,390 | 7,048,868 | 7,014,785 | 7,131,717 | 11/148,236 | 11/176,158 |
| 7,182,436 | 7,104,631 | 7,240,993 | 11/206,920 | 11/202,217 | 7,172,265 |
| 11/231,876 | 7,066,573 | 11/298,635 | 7,152,949 | 11/442,161 | 11/442,133 |
| 11/442,126 | 7,156,492 | 11/478,588 | 11/505,848 | 11/520,569 | 11/525,861 |
| 11/583,939 | 11/545,504 | 11/583,894 | 11/635,485 | 11/730,391 | 11/730,788 |
| 11/749,148 | 11/749,149 | 11/749,152 | 11/749,151 | 11/759,886 | 11/865,668 |
| 6,824,257 | 7,270,475 | 6,971,811 | 6,878,564 | 6,921,145 | 6,890,052 |
| 7,021,747 | 6,929,345 | 6,811,242 | 6,916,087 | 6,905,195 | 6,899,416 |
| 6,883,906 | 6,955,428 | 10/882,775 | 6,932,459 | 6,962,410 | 7,033,008 |
| 6,962,409 | 7,013,641 | 7,204,580 | 7,032,997 | 6,998,278 | 7,004,563 |
| 6,910,755 | 6,969,142 | 6,938,994 | 7,188,935 | 10/959,049 | 7,134,740 |
| 6,997,537 | 7,004,567 | 6,916,091 | 7,077,588 | 6,918,707 | 6,923,583 |
| 6,953,295 | 6,921,221 | 7,001,008 | 7,168,167 | 7,210,759 | 11/008,115 |
| 11/011,120 | 11/012,329 | 6,988,790 | 7,192,120 | 7,168,789 | 7,004,577 |
| 7,052,120 | 11/123,007 | 6,994,426 | 7,258,418 | 7,014,298 | 11/124,348 |
| 11/177,394 | 7,152,955 | 7,097,292 | 7,207,657 | 7,152,944 | 7,147,303 |
| 11/209,712 | 7,134,608 | 7,264,333 | 7,093,921 | 7,077,590 | 7,147,297 |
| 11/239,029 | 11/248,832 | 11/248,428 | 11/248,434 | 7,077,507 | 7,172,672 |
| 7,175,776 | 7,086,717 | 7,101,020 | 11/329,155 | 7,201,466 | 11/330,057 |
| 7,152,967 | 7,182,431 | 7,210,666 | 7,252,367 | 11/450,586 | 11/485,255 |
| 11/525,860 | 6,945,630 | 7,018,294 | 6,910,014 | 6,659,447 | 6,648,321 |

-continued

| | | | | | |
|---|---|---|---|---|---|
| 7,082,980 | 6,672,584 | 7,073,551 | 6,830,395 | 10/309,025 | 7,001,011 |
| 6,880,922 | 6,886,915 | 6,644,787 | 6,641,255 | 7,066,580 | 6,652,082 |
| 10/309,036 | 6,666,544 | 6,666,543 | 6,669,332 | 6,984,023 | 6,733,104 |
| 6,644,793 | 6,723,575 | 6,953,235 | 6,663,225 | 7,076,872 | 7,059,706 |
| 7,185,971 | 7,090,335 | 6,854,827 | 6,793,974 | 10/636,258 | 7,222,929 |
| 6,739,701 | 7,073,881 | 7,155,823 | 7,219,427 | 7,008,503 | 6,783,216 |
| 6,883,890 | 6,857,726 | 10/636,274 | 6,641,256 | 6,808,253 | 6,827,428 |
| 6,802,587 | 6,997,534 | 6,959,982 | 6,959,981 | 6,886,917 | 6,969,473 |
| 6,827,425 | 7,007,859 | 6,802,594 | 6,792,754 | 6,860,107 | 6,786,043 |
| 6,863,378 | 7,052,114 | 7,001,007 | 10/729,151 | 10/729,157 | 6,948,794 |
| 6,805,435 | 6,733,116 | 10/683,006 | 7,008,046 | 6,880,918 | 7,066,574 |
| 6,983,595 | 6,923,527 | 7,275,800 | 7,163,276 | 7,156,495 | 6,976,751 |
| 6,994,430 | 7,014,296 | 7,059,704 | 7,160,743 | 7,175,775 | 11/058,238 |
| 7,097,283 | 7,140,722 | 11/123,009 | 11/123,008 | 7,080,893 | 7,093,920 |
| 7,270,492 | 7,128,093 | 7,052,113 | 7,055,934 | 11/155,627 | 11/149,324 |
| 11/159,197 | 7,083,263 | 7,145,592 | 7,025,436 | 11/281,444 | 7,258,421 |
| 11/478,591 | 11/478,735 | 7,226,147 | 11/482,940 | 7,195,339 | 11/503,061 |
| 11/505,938 | 11/520,577 | 11/525,863 | 11/544,577 | 11/540,576 | 11/585,964 |
| 11/592,991 | 11/599,342 | 11/600,803 | 11/604,321 | 11/604,302 | 11/635,535 |
| 11/635,486 | 11/643,842 | 11/655,987 | 11/650,541 | 11/706,301 | 11/707,039 |
| 11/730,388 | 11/730,786 | 11/730,785 | 11/739,080 | 11/764,746 | 11/768,875 |
| 11/779,847 | 11/829,940 | 11,847,240 | 11/834,625 | 11/863,210 | 11/865,680 |
| 7,067,067 | 6,776,476 | 6,880,914 | 7,086,709 | 6,783,217 | 7,147,791 |
| 6,929,352 | 7,144,095 | 6,820,974 | 6,918,647 | 6,984,016 | 7,192,125 |
| 6,824,251 | 6,834,939 | 6,840,600 | 6,786,573 | 7,144,519 | 6,799,835 |
| 6,959,975 | 6,959,974 | 7,021,740 | 6,935,718 | 6,938,983 | 6,938,991 |
| 7,226,145 | 7,140,719 | 6,988,788 | 7,022,250 | 6,929,350 | 7,011,393 |
| 7,004,566 | 7,175,097 | 6,948,799 | 7,143,944 | 10/965,737 | 7,029,100 |
| 6,957,811 | 7,073,724 | 7,055,933 | 7,077,490 | 7,055,940 | 10/991,402 |
| 7,234,645 | 7,032,999 | 7,066,576 | 7,229,150 | 7,086,728 | 7,246,879 |
| 11/144,809 | 7,140,718 | 11/144,802 | 7,144,098 | 7,044,577 | 11/144,808 |
| 11/172,896 | 7,189,334 | 7,055,935 | 7,152,860 | 11/203,188 | 11/203,173 |
| 11/202,343 | 7,213,989 | 11/225,156 | 11/225,173 | 11/228,433 | 7,114,868 |
| 7,168,796 | 7,159,967 | 11/272,425 | 7,152,805 | 11/298,530 | 11/330,061 |
| 7,133,799 | 11/330,054 | 11/329,284 | 7,152,956 | 7,128,399 | 7,147,305 |
| 11/446,241 | 11/442,160 | 7,246,884 | 7,152,960 | 11/442,125 | 11/454,901 |
| 11/442,134 | 11/450,441 | 11/474,274 | 11/499,741 | 7,270,399 | 6,857,728 |
| 6,857,729 | 6,857,730 | 6,989,292 | 7,126,216 | 6,977,189 | 6,982,189 |
| 7,173,332 | 7,026,176 | 6,979,599 | 6,812,062 | 6,886,751 | 10/804,057 |
| 10/804,036 | 7,001,793 | 6,866,369 | 6,946,743 | 10/804,048 | 6,886,918 |
| 7,059,720 | 10/846,561 | 10/846,562 | 10/846,647 | 10/846,649 | 10/846,627 |
| 6,951,390 | 6,981,765 | 6,789,881 | 6,802,592 | 7,029,097 | 6,799,836 |
| 7,048,352 | 7,182,267 | 7,025,279 | 6,857,571 | 6,817,539 | 6,830,198 |
| 6,992,791 | 7,038,809 | 6,980,323 | 7,148,992 | 7,139,091 | 6,947,173 |
| 7,101,034 | 6,969,144 | 6,942,319 | 6,827,427 | 6,984,021 | 6,984,022 |
| 6,869,167 | 6,918,542 | 7,007,852 | 6,899,420 | 6,918,665 | 6,997,625 |
| 6,988,840 | 6,984,080 | 6,845,978 | 6,848,687 | 6,840,512 | 6,863,365 |
| 7,204,582 | 6,921,150 | 7,128,396 | 6,913,347 | 7,008,819 | 6,935,736 |
| 6,991,317 | 11/033,122 | 7,055,947 | 7,093,928 | 7,100,834 | 7,270,396 |
| 7,187,086 | 11/072,518 | 7,032,825 | 7,086,721 | 11/171,428 | 7,159,968 |
| 7,010,456 | 7,147,307 | 7,111,925 | 11/144,812 | 7,229,154 | 11/505,849 |
| 11/520,570 | 11/520,575 | 11/546,437 | 11/540,575 | 11/583,937 | 11/584,619 |
| 11/592,211 | 11/592,207 | 11/635,489 | 11/604,319 | 11/635,490 | 11/635,525 |
| 11/650,540 | 11/706,366 | 11/706,310 | 11/706,308 | 11/785,108 | 11/744,214 |
| 11,744,218 | 11,748,485 | 11,748,490 | 11/764,778 | 11/766,025 | 11/834,635 |
| 11/839,541 | 11/860,420 | 11/865,693 | 11/863,118 | 11/866,307 | 11/866,340 |
| 11/869,684 | 11/869,722 | 11/869,694 | 11/872,714 | | |

The disclosures of these applications and patents are incorporated herein by reference.

BACKGROUND OF THE INVENTION

Inkjet printing is a popular and versatile form of print imaging. The Assignee has developed printers that eject ink through MEMS printhead IC's. These printhead IC's (integrated circuits) are formed using lithographic etching and deposition techniques used for semiconductor fabrication.

The micro-scale nozzle structures in MEMS printhead IC's allow a high nozzle density (nozzles per unit of IC surface area), high print resolutions, low power consumption, self cooling operation and therefore high print speeds. Such printheads are described in detail in U.S. Ser. No. 10/160,273 filed Jun. 4, 2002 and U.S. Ser. No. 10/728,804 filed on Dec. 8, 2003 to the present Assignee. The disclosures of these documents are incorporated herein by reference.

The small nozzle structures and high nozzle densities can create difficulties with nozzle clogging, de-priming, nozzle drying (decap), color mixing, nozzle flooding, bubble contamination in the ink stream and so on. Each of these issues can produce artifacts that are detrimental to the print quality. The component parts of the printer are designed to minimize the risk that these problems will occur. The optimum situation would be printer components whose inherent function is able to preclude these problem issues from arising. In reality, the many different types of operating conditions, and mishaps or unduly rough handling during transport or day to day operation, make it impossible to address the above problems via the 'passive' control of component design, material selection and so on.

To address this, the Applicant has developed printers with active control of the fluidic systems. These active fluidic systems are described in co-pending application Ser. Nos. 11/482,982; 11/482,983; 11/482,984; 11/495,818; 11/495,819; 11/677,049; 11/677,050; 11/677,051, the contents of which are incorporated by cross reference. While these systems provide the user with the ability to actively manage the static and dynamic fluid conditions throughout the printer, it has been found that the active components within a printer are responsible for a large proportion of the ink borne contaminants. Pumps in particular are prone to shedding particles into the ink flow which can be detrimental to the operation of the nozzles. The wear and friction of surfaces acting against each other eventually generate particle which are directly entrained in the ink flow. Many of the above referenced fluidic designs use peristaltic pumps which introduce additional problems. The flexible tubing within the pump can eventually crack and leak, the tubing loses elasticity and no longer returns to a fully open condition, and the pump has a high torque requirement because of the need to compress the tubing enough to form a seal. To meet the torque requirements, the pump needs to be relatively large which is counter a compact form factor for the printer as a whole.

Ink borne contaminants can be removed with a filter upstream of the printhead. However, the particle size requires the filter pore size to be very small. To maintain the ink flow rate required by a high speed, pagewidth printhead, the filter surface area needs to be impractically large and precludes the compactness required by market expectations.

SUMMARY OF THE INVENTION

Accordingly, the present invention provides an inkjet printer comprising:

a printhead for printing onto a media substrate;

a reservoir for supplying ink to the printhead;

a pump for drawing ink from the reservoir and pumping ink into the printhead; and, a valve arrangement for selectively opening fluid communication between the pump and the printhead, and closing fluid communication between the pump and the printhead while opening fluid communication between the reservoir and the printhead.

The invention is predicated on the realization that the purging and priming functions of the pump can be performed while in fluid communication with the printhead and then be fluidically isolated from the printhead when printing. By removing the pump from the direct fluid line between the reservoir and the printhead, the valve arrangement allows it to connect to the reservoir or the printhead only when necessary. The purging and priming operations have become a two-stage processes where the pump initially draws a charge of ink from the reservoir and then delivers it to the printhead. The ink from the pump can be passed through a fine filter to remove any particulate contaminants without then constricting the ink flow from the reservoir during normal printing operations.

Preferably, the printer further comprises a filter for ink flowing from the pump to the printhead, the filter being positioned such that it is not in fluid communication with the printhead when the valve arrangement is configured for fluid communication between the reservoir and the printhead.

Preferably, the valve arrangement is configured such that the pump is not in fluid communication with the reservoir whenever the pump is in fluid communication with the printhead.

Preferably, the valve arrangement is configured such that the pump is not in fluid communication with the reservoir whenever the reservoir is in fluid communication with the printhead.

Preferably, the printer further comprises an upstream line for establishing fluid communication between the reservoir and the printhead wherein the valve arrangement is a three-way valve in the upstream line and the pump connects to the three-way valve via a branch line, the three way valve having three settings; a first setting connecting the upstream line to the reservoir to the upstream line to the printhead while closing the branch line, a second setting connecting the branch line to the upstream line to the reservoir while closing the upstream line to the printhead, and a third setting connecting the branch line to the upstream line to the printhead while closing the upstream line to the reservoir.

Preferably, the pump has a chamber with a reciprocating plunger. In another embodiment, the pump is a bulb of elastomeric material for holding a volume of ink and an actuator for selectively compressing the bulb.

Preferably, the reservoir has a pressure regulator for establishing a predetermined pressure in a headspace above the ink in the reservoir, the predetermined pressure being less than atmospheric pressure. In a further preferred form, the pump draws ink from the reservoir to reduce the pressure in the headspace to the predetermined pressure in preparation for printing.

Preferably, the ink drawn from the reservoir by the pump in preparation for printing is pumped into the printhead in preparation for printing. Preferably, the printhead has a distribution manifold and a plurality of printhead integrated circuits mounted to the distribution manifold such that priming the distribution manifold with ink also primes the printhead integrated circuits.

BRIEF DESCRIPTION OF THE DRAWINGS

Preferred embodiments of the invention will now be described by way of example only, with reference to the accompanying drawings in which.

DETAILED DESCRIPTION OF THE PREFERRED EMBODIMENTS

Figure 1:
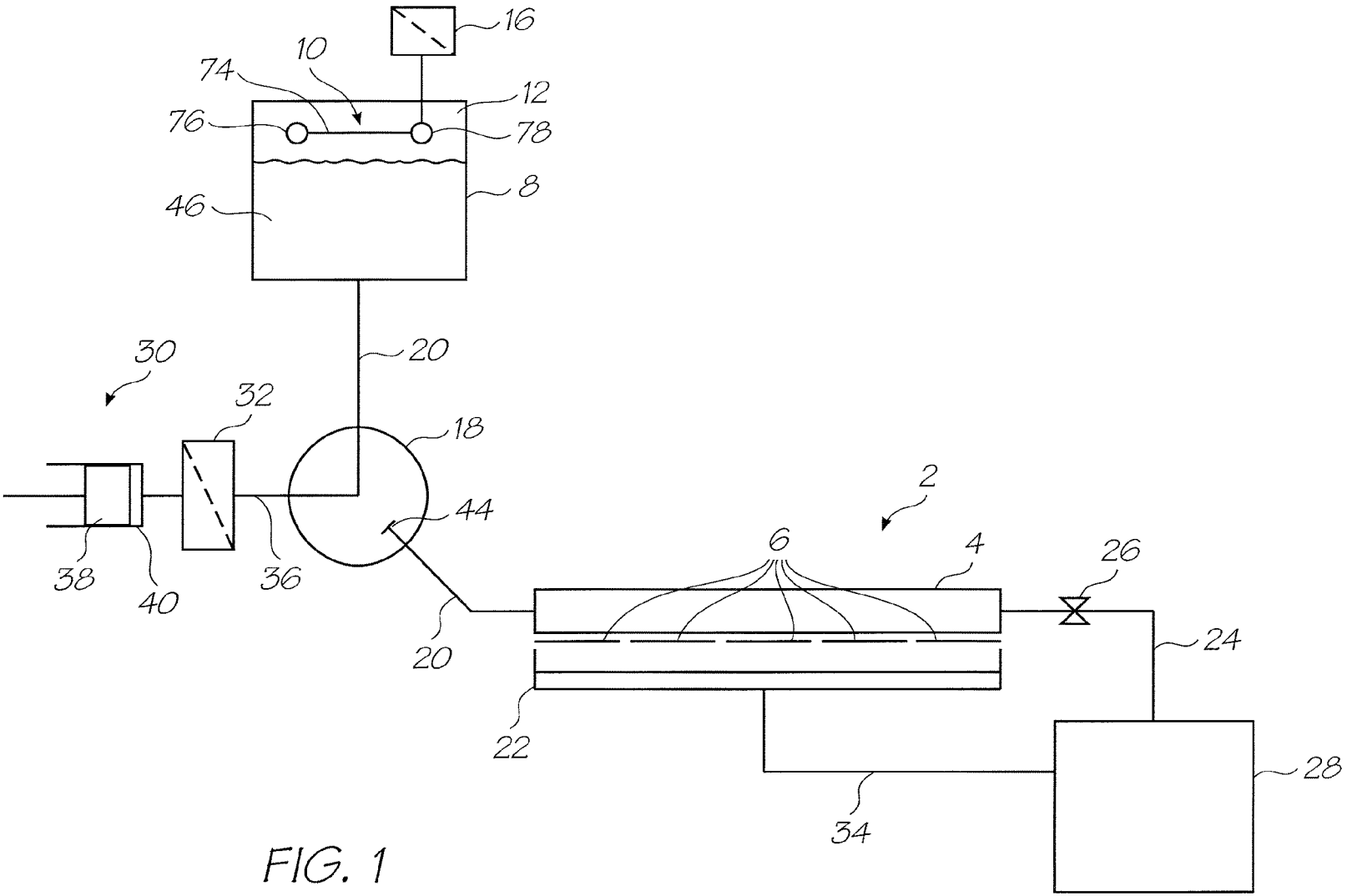
FIG. 1 shows a schematic diagram of a printer fluidic system according to the present invention whilst in a standby mode.
Figure 2:
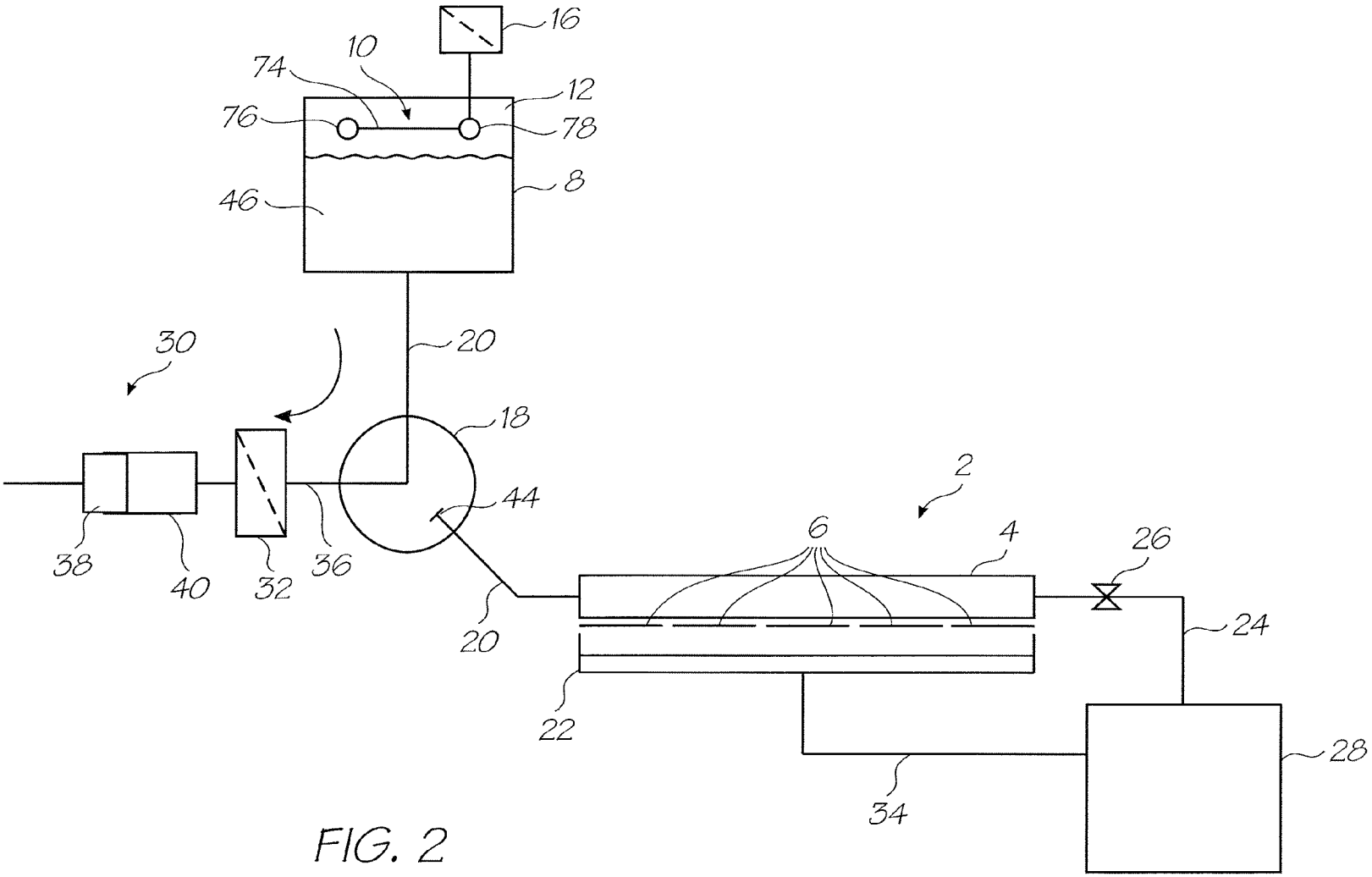
FIG. 2 shows the fluidic system of FIG. 1 in a ink tank pressurization mode.
Figure 3:
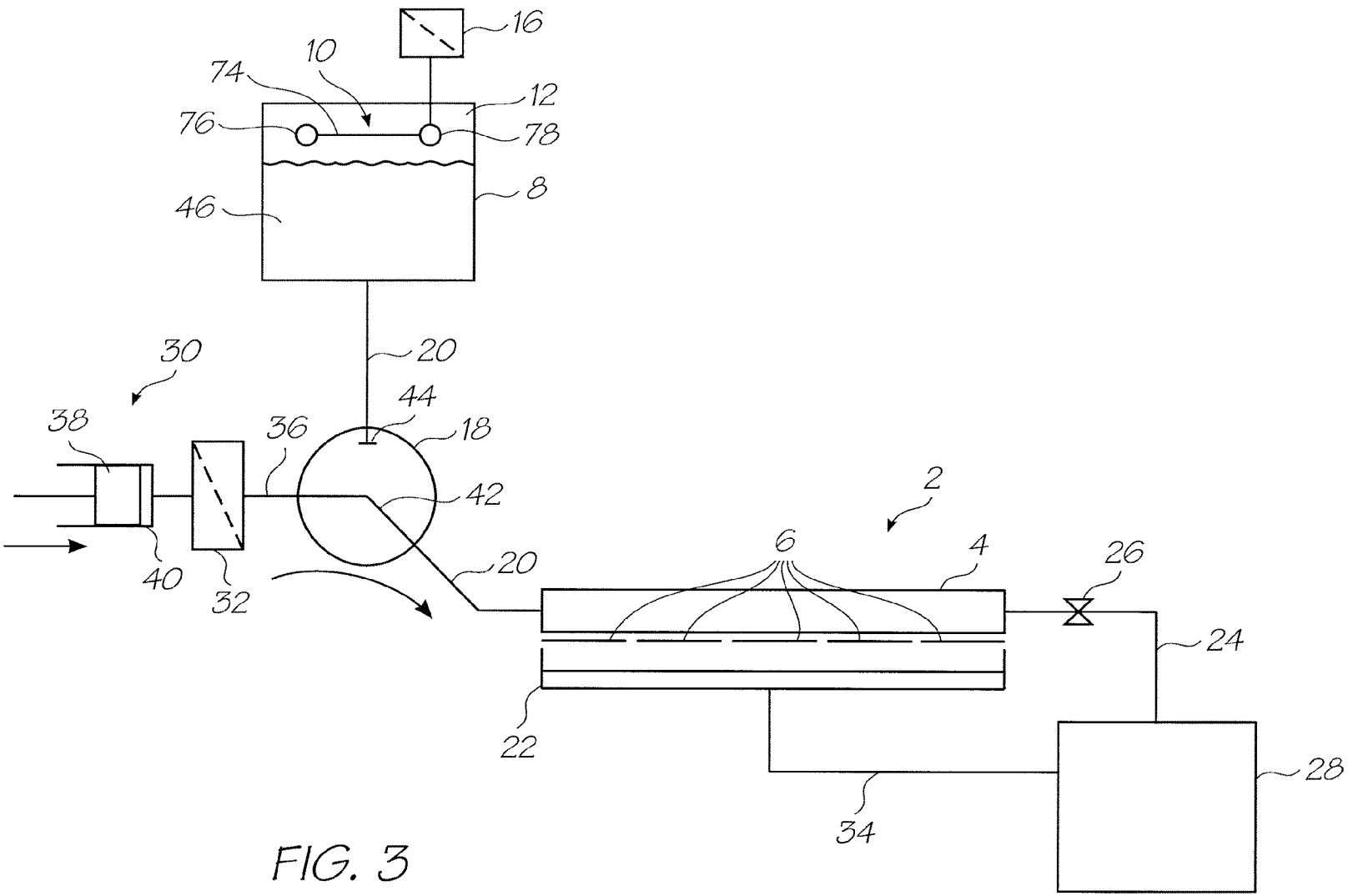
FIG. 3 shows the fluidic system of FIG. 1 in a printhead priming/purging mode.

Referring to FIGS. 1 to 3, the printer fluidics system is shown schematically for the purposes of illustration. The fluidic architecture shown in the figures is for a single ink line for one color only. A color printer would have separate lines and ink tanks for each ink color. Most of the individual components within the system are shown and described in much greater detail in the Applicant's co-pending application U.S. Ser. No. 11/688,863, filed on Mar. 21, 2007, the contents of which are incorporated herein by cross reference. Components of the present system that are not shown in the cross referenced document, are commercially available.

The fluidic system shown in FIGS. 1 to 3 has a printhead 2 supplied with ink 46 from an ink tank 8 via an upstream ink line 20. The upstream ink line 20 has a three-way valve 18 which connects to the pump 30 via a filter 32. A downstream line 24 connects the printhead 2 to a sump 28 via a shut off valve 26. The printhead has a maintenance station 22 for capping, blotting and wiping the nozzles. A drain line 34 connects the maintenance station 22 to the sump 28.

The printhead 2 is an assembly of an ink distribution manifold 4 on which a series of printhead integrated circuits (ICs) 6 are mounted. The printhead ICs 6 define the nozzle arrays which eject the ink to the media substrate. The nozzles are MEMS devices which can be thermally actuated such as those described in U.S. Ser. No. 11/482,953 filed on Jul. 10, 2006 or mechanically actuated such as those disclosed in U.S. Ser. No. 10/160,273 filed Jun. 4, 2002.

The ink distribution manifold 4 is an LCP molding with a system of large channels feeding a network of smaller channels to supply the ink to many points along the length of each printhead IC 6. An embodiment of the distribution manifold 4 and the printhead ICs 6 is disclosed in detail in U.S. Ser. No. 11/688,863 filed Mar. 21, 2007 reference listed above. This document also details the manner in which the printhead is primed with ink or, if necessary, purged of ink to correct any cross channel color contamination and/or bubble removal.

The ink tank 8 and the bubble point pressure regulator 10 are described in co-pending U.S. Ser. No. 11/872,714 filed Oct. 16, 2007, incorporated herein by reference. However, for the purposes of this description, the regulator 10 is shown as a bubble outlet 76 in the tank headspace 12 and vented to atmosphere via microchannel 74 extending to an air inlet 78. Ink is retained in the microchannel 74 by capillary action. As the printhead IC's 6 consume ink, the pressure in the tank 8 drops until the pressure difference at the bubble outlet 76 sucks air into the tank. The air is drawn through an air filter 16 to remove contaminants that might clog or obstruct the microchannel 74. The filtered air forms a bubble in the ink within the micrchannel 74 which travels to the outlet 76. This pressure difference is the bubble point pressure and will depend on the diameter (or smallest dimension) of the microchannel 74 and the Laplace pressure of the ink meniscus. This maintains a constant negative pressure in the headspace 12. The hydrostatic pressure in the ink at the outlet to the tank 8 will vary as the ink level drops. To minimize this variation, the ink tanks 8 are dimensioned to be short and squat.

Figure 5:
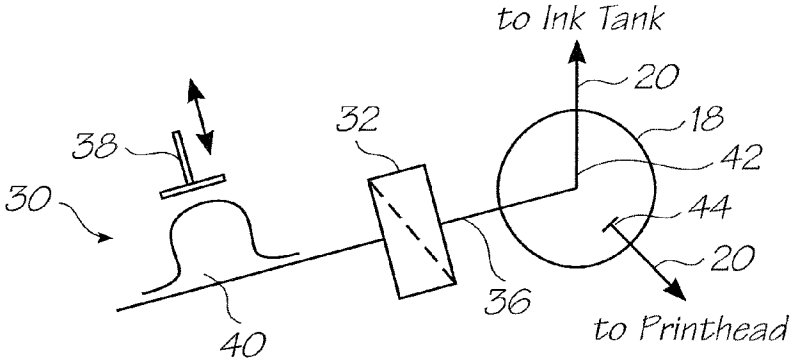
FIG. 5 schematically shows an alternative ink pump arrangement for the fluidic system.

FIG. 1 shows the printer is a standby mode. The printhead 2 is fluidically isolated from the ink tank 8 by the three-way valve 18. This prevents any ink mixing across the nozzles of the printhead ICs 6 from diffusing up into the tank 8. The valve 18 connects the tank 8 to the pump 30 via the branch line 36. The pump 30 is a piston 38 that reciprocates in a chamber 40. It is possible to use a peristaltic pump but these suffer the problems discussed above in the background to the invention. Namely, the potential for failure of the tubes, inaccuracy as the tubes no longer return to their original uncompressed shape and high torque requirements. A more suitable pump is shown in FIG. 5. The branch line 36 feeds a bulb 30 of elastomeric material. Actuator 38 compresses or releases the bulb 30 to pump ink toward the printhead or draw ink from the tank.

During long periods of standby, the pressure in the headspace 12 can rise above the bubble point pressure. Outgassing of dissolved gases, and diurnal temperature variation can cause pressure increases. In the worst case, the headspace 12 pressure is no longer negative relative to atmosphere.

FIG. 2 shows the printer coming out of standby and preparing for a print job. The piston 38 retracts in the chamber 40 to draw ink 46 out of the tank 8. The ink displacement lowers the air pressure in the headspace 12 until the bubble point regulator 10 allows air into the tank 8. With the headspace at the bubble point pressure, the negative hydrostatic pressure of the ink is within the expected operating range required by the printhead 2.

FIG. 3 shows the priming or purging of the printhead 2 in preparation for printing. The valve 18 is reconfigured to close fluid communication between the pump 30 and the tank 8, and open fluid communication between the pump 30 and the printhead 2. The ink in the pump is forced out of the chamber 40 by depressing the piston 38. The ink is forced through the filter 32 to remove any particulate contaminants shed by the pump. To prime the printhead 2, ink is forced into the main channels of the ink distribution manifold 4 and from there, capillary action primes the small conduits and the nozzles in each of the printhead ICs 6. This is done with the shut off valve 26 in the downstream line 24 open so that any excess ink feeds straight to the sump 28.

If the printhead 2 contains ink when it is brought out of standby, it may be necessary to remove air bubbles or mixed ink. The problem of ink mixing is discussed in detail in the cross referenced application U.S. Ser. No. 11/688,863 filed Mar. 21, 2007, listed above. Put briefly, the ink from nozzles of one color can wick across the surface of the printhead ICs 6, and diffuse into ink in the nozzles and supply lines for another color. This is corrected with a printhead purge. The downstream shutoff valve 26 is closed and filtered ink from the pump 30 is forced through the distribution manifold 4 to flood the printhead ICs 6. The maintenance station 22 cleans away the flooded ink.

Figure 4:
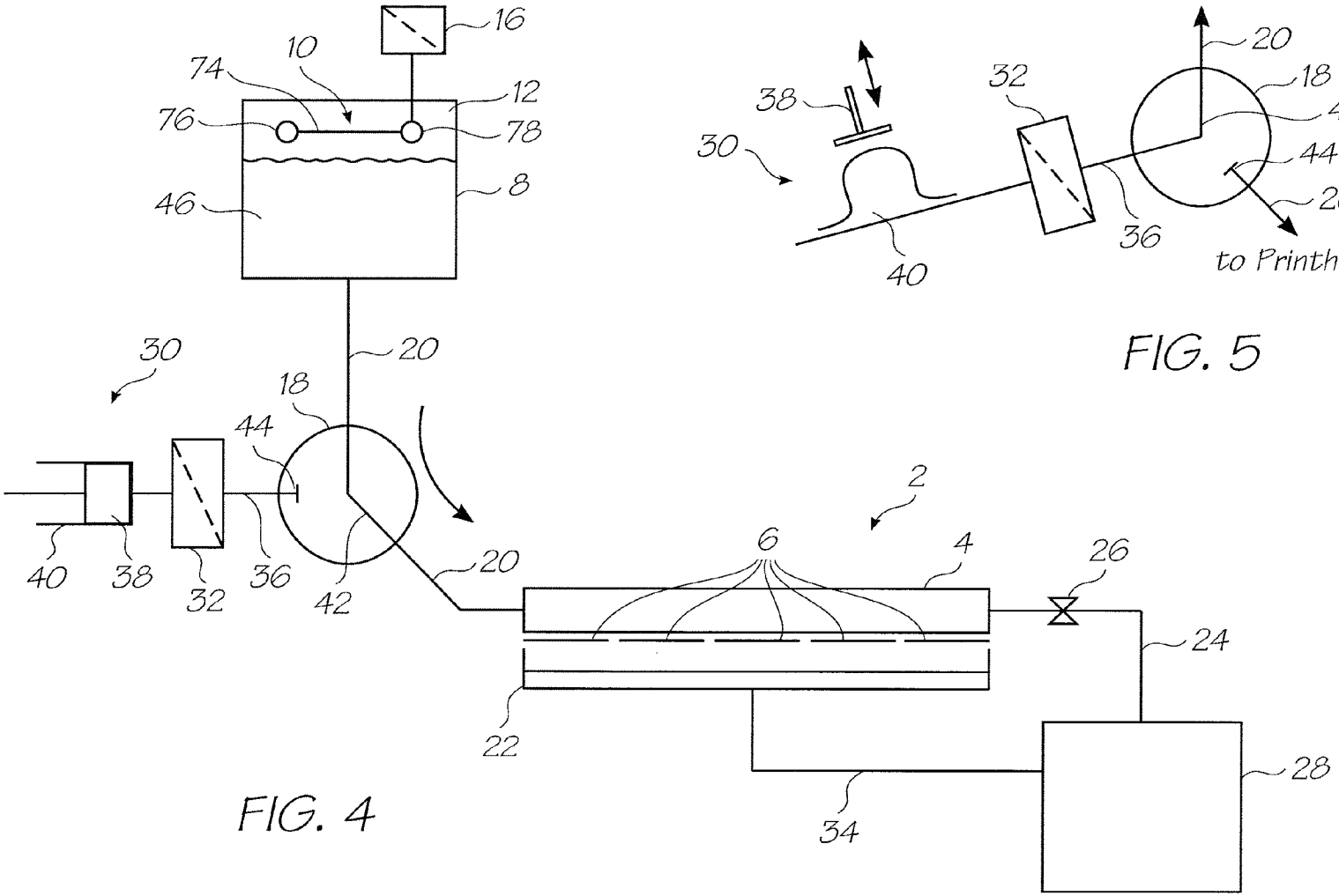
FIG. 4 shows the fluidic system of FIG. 1 in the printing mode.

FIG. 4 shows the printer in printing mode. The three-way valve 18 is configured to fluidly connect the tank 8 to the printhead 2. The blind end 44 seals off the branch line 36 to the pump 30. The ejection of ink from the nozzles on the printhead ICs 6 draws ink from the ink tank 8. The upstream ink line 20 is not constricted by the filter 32 or any of the structural elements of the pump 30. In the embodiment shown in U.S. Ser. No. 11/688,873, filed on Mar. 21, 2007, the printhead 2 is a pagewidth printhead that prints full color at photographic quality resolution at a rate greater than one page per second. This requires a high ink supply flow rate which is not throttled by unnecessary elements in the upstream ink line 20.

At the completion of the print job, the printer can return to standby mode as shown in FIG. 1. The valve 18 moves the blind end 44 over the upstream ink line 20 to seal the printhead 2 from the tank 8. This prevents any ink mixing at the printhead from reaching the ink tank. Ink contamination in the tank would be irretrievable and has to be replaced. As a further safeguard against color mixing, the shut off valve 26 is held open during standby. The sump 28 is at a lower elevation relative to the printhead ICs 6. This allows the column of ink in the downstream ink line 24 to 'hang' from the distribution manifold 4 to create a negative hydrostatic pressure at the printhead ICs 6. A negative pressure at the nozzles draws the ink meniscus inwards and inhibits color mixing.

The maintenance station 22 that seals the nozzles during standby periods to avoid dehydration of the printhead ICs 6 and shield the nozzle plate from paper dust and other particulates. The maintenance station 22 is also configured to wipe the nozzle plate to remove dried ink and other contaminants. Dehydration of the printhead ICs 6 occurs when the ink solvent, typically water, evaporates and increases the viscosity of the ink. If the ink viscosity is too high, the ink ejection actuators fail to eject ink drops. Dehydrated nozzles are typically a problem when reactivating the printer after a power down or standby period.

The problems outlined above are not uncommon during the operative life of a printer and can be effectively corrected with the relatively simple fluidic architecture shown in the figures. It also allows the user to initially prime the printer, deprime the printer prior to moving it, or restore the printer to a known print ready state using simple trouble-shooting protocols. Several examples of these situations are described in detail in the above referenced U.S. Ser. No. 11/677,049 filed on Feb. 21, 2007.

The invention has been described by way of example only. Ordinary workers in this field will readily recognize any variations and modifications which do not depart from the spirit and scope of the broad inventive concept.

The invention claimed is:

1. An inkjet printer comprising:

a printhead for printing onto a media substrate;

a reservoir for supplying ink to the printhead;

a pump for drawing ink from the reservoir and pumping ink into the printhead; and, a valve arrangement for selectively opening fluid communication between the pump and the printhead, and closing fluid communication between the pump and the printhead while opening fluid communication between the reservoir and the printhead, wherein the valve arrangement is configured such that the pump is not in fluid communication with the reservoir whenever the pump is in fluid communication with the printhead.

2. An inkjet printer according to claim 1 further comprising a filter for ink flowing from the pump to the printhead, the filter being positioned such that it is not in fluid communication with the printhead when the valve arrangement is configured for fluid communication between the reservoir and the printhead.

3. An inkjet printer according to claim 1 wherein the valve arrangement is configured such that the pump is not in fluid communication with the reservoir whenever the reservoir is in fluid communication with the printhead.

4. An inkjet printer according to claim 3 further comprising an upstream line for establishing fluid communication between the reservoir and the printhead wherein the valve arrangement is a three-way valve in the upstream line and the pump connects to the three-way valve via a branch line, the three way valve having three settings; a first setting connecting the upstream line to the reservoir to the upstream line to the printhead while closing the branch line, a second setting connecting the branch line to the upstream line to the reservoir while closing the upstream line to the printhead, and a third setting connecting the branch line to the upstream line to the printhead while closing the upstream line to the reservoir.

5. An inkjet printer according to claim 1 wherein the pump has a chamber with a reciprocating plunger.

6. An inkjet printer according to claim 1 wherein the pump is a bulb of elastomeric material for holding a volume of ink and an actuator for selectively compressing the bulb.

7. An inkjet printer according to claim 1 wherein the reservoir has a pressure regulator for establishing a predetermined pressure in a headspace above the ink in the reservoir, the predetermined pressure being less than atmospheric pressure.

8. An inkjet printer according to claim 7 wherein the pump draws ink from the reservoir to reduce the pressure in the headspace to the predetermined pressure in preparation for printing.

9. An inkjet printer according to claim 8 wherein the ink drawn from the reservoir by the pump in preparation for printing is pumped into the printhead in preparation for printing.

10. An inkjet printer according to claim 1 wherein the printhead has a distribution manifold and a plurality of printhead integrated circuits mounted to the distribution manifold such that priming the distribution manifold with ink also primes the printhead integrated circuits.

* * * * *